US011061355B2

(12) United States Patent
Suzuki

(10) Patent No.: US 11,061,355 B2
(45) Date of Patent: Jul. 13, 2021

(54) IMAGE FORMING APPARATUS

(71) Applicant: Oki Data Corporation, Tokyo (JP)

(72) Inventor: Shuichi Suzuki, Tokyo (JP)

(73) Assignee: Oki Data Corporation, Tokyo (JP)

( * ) Notice: Subject to any disclaimer, the term of this patent is extended or adjusted under 35 U.S.C. 154(b) by 173 days.

(21) Appl. No.: 16/515,185

(22) Filed: Jul. 18, 2019

(65) Prior Publication Data

US 2020/0073310 A1 Mar. 5, 2020

(30) Foreign Application Priority Data

Aug. 30, 2018 (JP) ..... JP2018-161086

(51) Int. Cl.
*G03G 15/00* (2006.01)

(52) U.S. Cl.
CPC ..... *G03G 15/70* (2013.01); *G03G 2215/0485* (2013.01)

(58) Field of Classification Search
CPC ..... G03G 15/20; G03G 2215/048; G03G 2215/0485
See application file for complete search history.

(56) References Cited

U.S. PATENT DOCUMENTS 10,078,298 B2 * 9/2018 Sato ..... G03G 15/2017
2009/0214125 A1 * 8/2009 Okumura ..... G09G 5/00 382/229
2012/0120456 A1 * 5/2012 Shiho ..... H04N 1/00578 358/448

FOREIGN PATENT DOCUMENTS

JP 2000181283 A * 6/2000
JP 2016-065962 A 4/2016
JP 2016065962 A * 4/2016

* cited by examiner

*Primary Examiner* — Jennifer E Simmons
(74) *Attorney, Agent, or Firm* — Muncy, Geissler, Olds & Lowe, P.C.

(57) ABSTRACT

An image forming apparatus includes a receiving part that receives multiple page images including a first page image and a second page image, a medium carrying part that carries the recording media, and an image forming part that forms images on the recording media carried by the medium carrying part based on the first and second page images processed by the image processing part. The image processing part determines one edge region of the first page image, which has the highest image density among four edge regions on the first page image, changes the orientation of the first page image such that the one edge region having the highest image density is arranged to be at the trailing side of the first page image, and changes the orientation of the second page image to the same orientation as that of the first page image.

14 Claims, 19 Drawing Sheets

IMAGE FORMING APPARATUS

TECHNICAL FIELD

This invention relates to an image forming apparatus that forms images on sheets of recording medium.

BACKGROUND

In an image forming apparatus, while carrying a recording medium, a jam of the recording medium may occur. Disclosed in Patent Document 1 is an image forming apparatus that calculates the possibility that a recording medium jam occurs, and changes the position of an image transferred to the recording medium based on the calculation result.

RELATED ART

[Patent Doc. 1] JP Laid-Open Patent Application Publication 2016-65962

In an image forming apparatus, it is desired that a recording medium jam is hard to occur, and making it hard to occur is expected.

It is desired to offer an image forming apparatus that prevents a recording medium jam.

SUMMARY

An image forming apparatus, disclosed in the application, includes a receiving part that receives multiple page images including a first page image and a second page image, which either leads or follows the first page image, from an external device, each of the first and second page images being to be formed on one of recording media wherein the first and second page images are in a rectangular shape with four sides surrounding their boundaries and each have orientations that coincides with a carrying direction of the recording media, and in accordance with the orientations, one leading side, one trailing side and two lateral sides, which are positioned between the leading side and the trailing side, are defined from the four sides of the first and second page images, an image processing part that calculates image densities of four edge regions that correspond to the four sides of the first page image so as to obtain a calculation result, and changes the orientations of the first and second page images based on the calculation result, a medium carrying part that carries the recording media, and an image forming part that forms images on the recording media carried by the medium carrying part based on the first and second page images processed by the image processing part, wherein the image processing part determines one edge region of the first page image, which has the highest image density among the four edge regions on the first page image, changes the orientation of the first page image such that the one edge region having the highest image density is arranged to be at the trailing side of the first page image, and changes the orientation of the second page image to the same orientation as that of the first page image.

Another image forming apparatus, disclosed in the application, includes a receiving part that receives multiple page images including a first page image and a second page image, which either leads or follows the first page image, from an external device, each of the first and second page images being to be formed on one of recording media wherein the first and second page images are in a rectangular shape with four sides surrounding their boundaries and each have orientations that coincides with a carrying direction of the recording media, and in accordance with the orientations, one leading side, one trailing side and two lateral sides, which are positioned between the leading side and the trailing side, are defined from the four sides of the first and second page images, an image processing part that calculates margin widths of four edge regions that correspond to the four sides of the first page image so as to obtain a calculation result, and changes the orientations of the first and second page images based on the calculation result, a medium carrying part that carries the recording media, and an image forming part that forms images on the recording media carried by the medium carrying part based on the first and second page images processed by the image processing part, wherein the image processing part determines one edge region of the first page image, which has the narrowest margin width among the four edge regions on the first page image, changes the orientation of the first page image such that the one edge region having the narrowest margin width is arranged to be at the trailing side of the first page image, and changes the orientation of the second page image to the same orientation as that of the first page image.

According to a first image forming apparatus in an embodiment of this invention, the orientation of the first page image is changed so as to dispose an edge region whose image density is the highest among four edge regions of the first page image near the trailing edge of a recording medium carried by a medium carrying part, and the orientation of the second page image is changed to the same orientation as the first page image, thereby a recording medium jam can be made hard to occur.

According to a second image forming apparatus in an embodiment of this invention, the orientation of the first page image is changed so as to dispose an edge region whose margin width is the narrowest among four edge regions of the first page image near the trailing edge of a recording medium carried by a medium carrying part, and the orientation of the second page image is changed to the same orientation as the first page image, thereby a recording medium jam can be made hard to occur.

DETAILED DESCRIPTIONS OF THE PREFERRED EMBODIMENT(S)

Below, embodiments of this invention are explained in detail referring to drawings. Note that the explanations are given in the following order: 1. First embodiment, and 2. Second embodiment.

1. First Embodiment

Configuration Example

Figure 1:
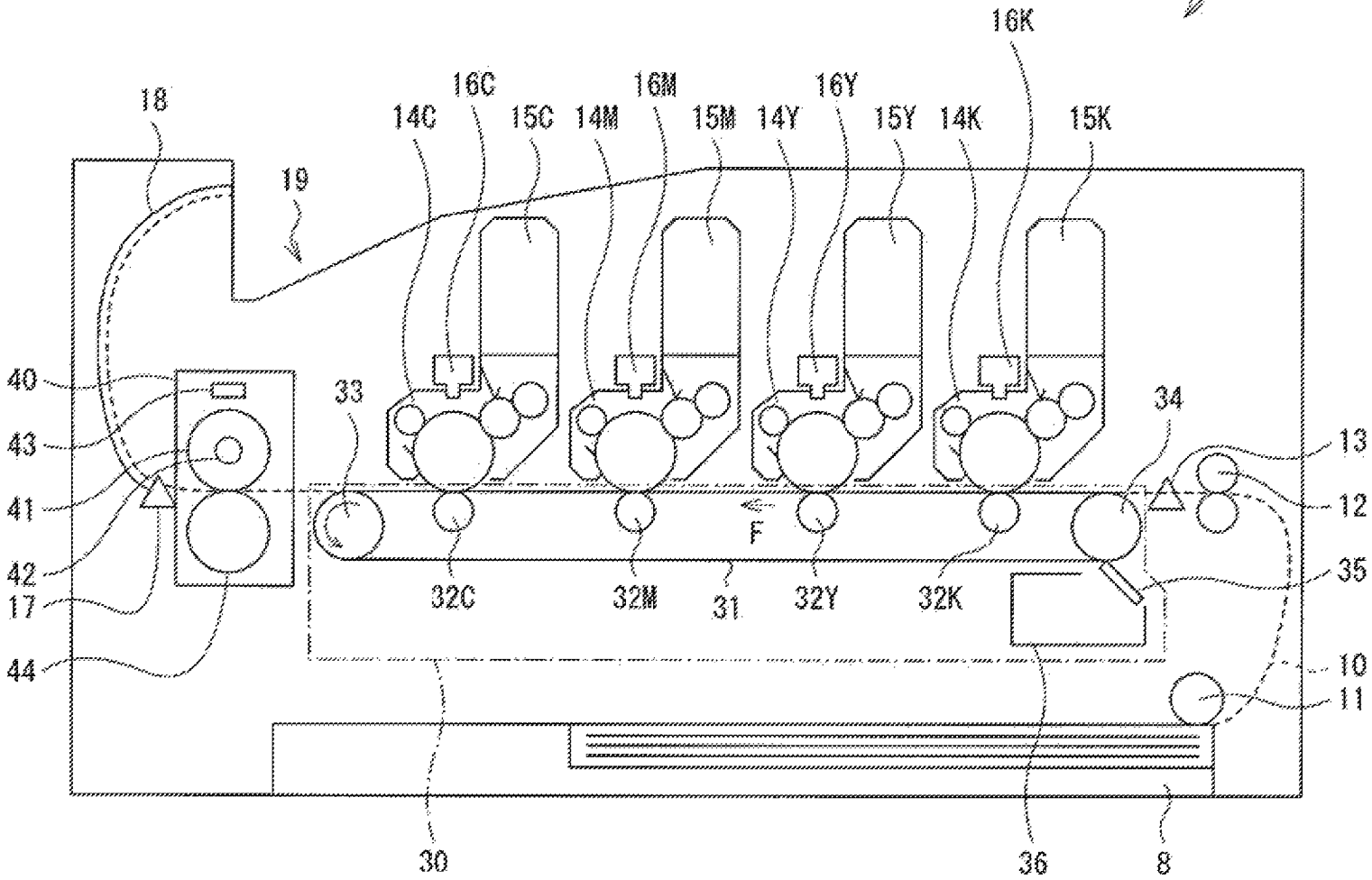
FIG. 1 is an explanatory diagram showing a configuration example of an image forming apparatus of an embodiment.

FIG. 1 shows a configuration example of an image forming apparatus (image forming apparatus 1) of an embodiment of this invention. The image forming apparatus 1 is a printer that forms images using an electrophotographic system onto recording media made of normal paper, for example. The image forming apparatus 1 is provided with a medium containing part 8, a hopping roller 11, a registration roller 12, a medium sensor 13, four development units 14 (development units 14K, 14Y, 14M, and 14C), four toner accommodation parts 15 (toner accommodation parts 15K, 15Y, 15M, and 15C), four exposure heads 16 (exposure heads 16K, 16Y, 16M, and 16C), a transfer part 30, a fuser part 40, a medium sensor 17, and a medium guide 18. These members are disposed along a carrying route 10 to carry sheets of recording medium 9.

The medium containing part 8 is configured so as to contain sheets 9, which are an example of recording media, and also supply the contained sheets 9 to the carrying route 10. In the present invention, the recording media means paper sheets, plastic films, any types of material on which an image is formed. The medium containing part 8 is designed so that the sheets 9 can be selectively set in the portrait orientation or the landscape orientation. Although one medium containing part 8 is installed in the image forming apparatus 1 in this example, multiple medium containing parts 8 can be installed. In this case, the multiple medium containing parts 8 can include a medium containing part having sheets 9 set in the landscape orientation and a medium containing part having sheets 9 set in the portrait orientation.

The hopping roller 11 is configured so as to extract the sheets 9 contained in the medium containing part 8 by one piece at a time from the top part, and forward the extracted sheet 9 to the carrying route 10. The hopping roller 11 is designed to rotate by a power transmitted from a hopping motor 61 (mentioned below).

The registration roller 12 is configured of a pair of rollers nipping the carrying route 10. The registration roller 12 corrects skew of the sheet 9 supplied from the hopping roller 11 and carries the sheet 9 along the carrying route 10. The registration roller 12 is designed to rotate by a power transmitted from the registration motor 62 (mentioned below).

The medium sensor 13 is disposed in the upstream side of the four development units 14 and is configured so as to detect the passage of the sheet 9. The medium sensor 13 is designed to supply its detection result to a printer engine control part 67 (mentioned below).

The four development units 14 are configured so as to form toner images. Specifically, the development unit 14K forms a black (K) toner image, the development unit 14Y forms a yellow (Y) toner image, the development unit 14M forms a magenta (M) toner image, and the development unit 14C forms a cyan (C) toner image. In this example, the four development units 14 are arranged in the order of the development units 14K, 14Y, 14M, and 14C in the carrying direction F of the sheets 9. Each of the development units 14 is configured in a detachable manner.

The four toner accommodation parts 15 are configured so as to accommodate toners. Specifically, the toner accommodation part 15K accommodates black toner, the toner accommodation part 15Y accommodates yellow toner, the toner accommodation part 15M accommodates magenta toner, and the toner accommodation part 15C accommodates cyan toner. The four toner accommodation parts 15 are configured detachably from the corresponding four development units 14, respectively.

Figure 2:
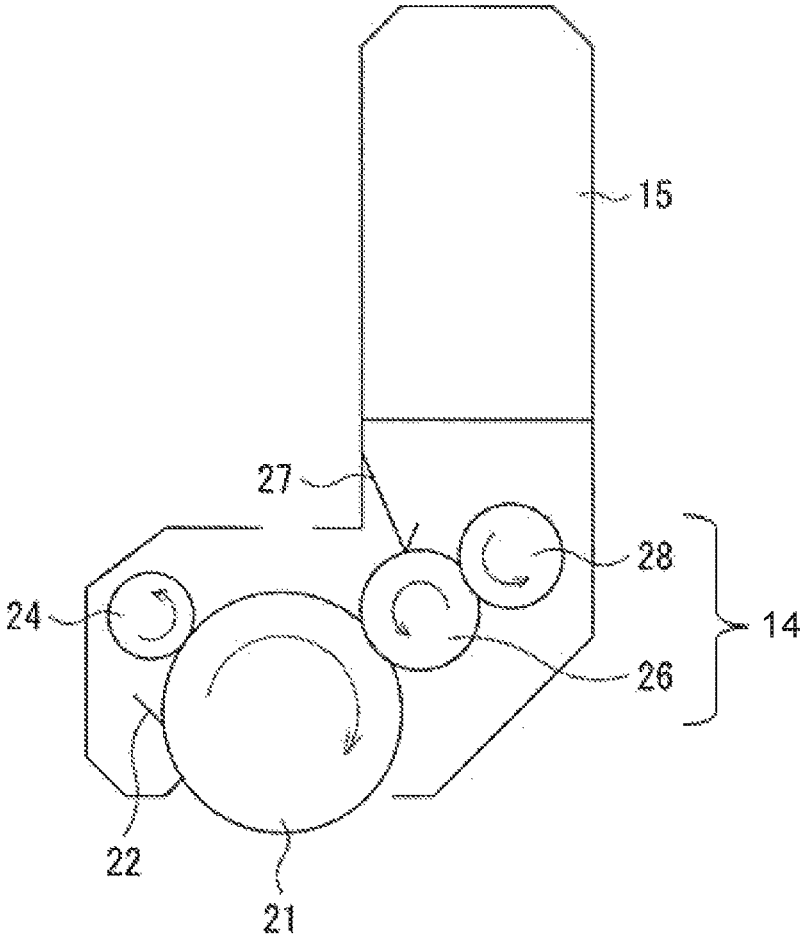
FIG. 2 is an explanatory diagram showing a configuration example of a development unit shown in FIG. 1.

FIG. 2 shows a configuration example of the development unit 14. Note that in FIG. 2 the toner accommodation part 15 is also shown. The development unit 14 has a photosensitive drum 21, a cleaning blade 22, a charging roller 24, a development roller 26, a development blade 27, and a supply roller 28.

The photosensitive drum 21 is configured so as to carry an electrostatic latent image on its surface (surface layer part). The photosensitive drum 21 rotates clockwise in this example by a power transmitted from a drum motor 63 (mentioned below). The photosensitive drum 21 is charged by the charging roller 24 and exposed by the exposure head 16. Specifically, the photosensitive drum 21 of the development unit 14K is exposed by the exposure head 16K, the photosensitive drum 21 of the development unit 14Y is exposed by the exposure head 16Y, the photosensitive drum 21 of the development unit 14M is exposed by the exposure head 16M, and the photosensitive drum 21 of the development unit 14C is exposed by the exposure head 16C. Thereby, an electrostatic latent image is formed on the surface of each photosensitive drum 21. Then, by toner being supplied by the development roller 26 to the photosensitive drum 21, a toner image corresponding to the electrostatic latent image is formed on the photosensitive drum 21.

The cleaning blade 22 is configured so as to perform cleaning by scraping off toner remaining on the surface (surface layer part) of the photosensitive drum 21.

The charging roller 24 is configured so as to charge the surface (surface layer part) of the photosensitive drum 21. The charging roller 24 is disposed so as to be in contact with the surface (circumferential face) of the photosensitive drum 21 and pressed against the photosensitive drum 21 with a prescribed amount of pressing force. The charging roller 24 rotates anticlockwise in this example according to the rotation of the photosensitive drum 21. It is designed that a charging voltage is applied to the charging roller 24 by a high-voltage power supply 56 (mentioned below).

The development roller 26 is configured so as to carry toner on its surface. The development roller 26 is disposed so as to be in contact with the surface (circumferential face) of the photosensitive drum 21 and pressed against the photosensitive drum 21 with a prescribed amount of pressing force. The development roller 26 rotates anticlockwise in this example by a power transmitted from the drum motor 63 (mentioned below). It is designed that a development voltage is applied to the development roller 26 by the high-voltage power supply 56 (mentioned below).

The development blade 27 is configured so as to contact with the surface of the development roller 26, thereby forming a layer made of toner (toner layer) on the surface of this development roller 26 and regulate (control, adjust) the thickness of the toner layer. The development blade 27 is, for example, a plate-shaped elastic member made of stainless steel bent in an L-shape. The development blade 27 is disposed so that its bent part is in contact with the surface of the development roller 26 and pressed against the development roller 26 with a prescribed amount of pressing force.

The supply roller 28 is configured so as to provide the development roller 26 with toner supplied from the toner accommodation part 15. The supply roller 28 is disposed so as to be in contact with the surface (circumferential face) of the development roller 26 and pressed against the development roller 26 with a prescribed amount of pressing force. The supply roller 28 rotates anticlockwise in this example by a power transmitted from the drum motor 63 (mentioned below). Thereby, in each development unit 14, friction occurs between the surface of the supply roller 28 and the surface of the development roller 26. As a result, in each development unit 14, toner is charged by so-called frictional charging. It is designed that a supply voltage is applied to the supply roller 28 by the high-voltage power supply 56 (mentioned below).

The four exposure heads 16 (FIG. 1) are configured so as to radiate light onto the photosensitive drum 21 of the corresponding development units 14, respectively. Specifically, the exposure head 16K is configured so as to radiate light onto the photosensitive drum 21 of the development unit 14K, the exposure head 16Y to radiate light onto the photosensitive drum 21 of the development unit 14Y, the exposure head 16M to radiate light onto the photosensitive drum 21 of the development unit 14M, and the exposure head 16C to radiate light onto the photosensitive drum 21 of the development unit 14C. The exposure head 16 has multiple light-emitting diodes arranged in the main scanning line direction (depth direction in FIG. 1), and radiates light onto the photosensitive drum 21 in dots using these light-emitting diodes. Thereby, these photosensitive drums 21 are designed to be exposed to light by the corresponding exposure heads 16 to form an electrostatic latent image on the surface of each of the photosensitive drums 21.

The transfer part 30 is configured so as to transfer the toner images formed on the four development units 14 onto the transfer target face of each sheet 9. The transfer part 30 has a transfer belt 31, four transfer rollers 32 (32K, 32Y, 32M, and 32C), a drive roller 33, a driven roller 34, a cleaning blade 35, and a cleaner container 36.

The transfer belt 31 is configured so as to carry sheets 9 along the carrying route 10 in the carrying direction F. The transfer belt 31 is stretched by the drive roller 33 and the driven roller 34. Then, the transfer belt 31 is designed to be circularly carried in the carrying direction F according to the rotation of the drive roller 33.

The transfer roller 32K is disposed opposing the photosensitive drum 21 of the development unit 14K through the carrying route 10 and the transfer belt 31, the transfer roller 32Y is disposed opposing the photosensitive drum 21 of the development unit 14Y through the carrying route 10 and the transfer belt 31, the transfer roller 32M is disposed opposing the photosensitive drum 21 of the development unit 14M through the carrying route 10 and the transfer belt 31, and the transfer roller 32C is disposed opposing the photosensitive drum 21 of the development unit 14C through the carrying route 10 and the transfer belt 31. A transfer voltage is applied by the high-voltage power supply 56 (mentioned below) to each of the transfer rollers 32K, 32Y, 32M, and 32C. Thereby, in the image forming apparatus 1, the toner images formed by the development units 14 are designed to be transferred to the transfer target face of each sheet 9.

The drive roller 33 is configured so as to stretch the transfer belt 31 together with the driven roller 34 and also circularly carry this transfer belt 31. In this example, the drive roller 33 is disposed in the downstream side of the four development units 14 in the carrying direction F. The drive roller 33 is designed to rotate anticlockwise in this example by a power transmitted from a belt motor 64 (mentioned below).

The driven roller 34 is configured so as to stretch the transfer belt 31 together with the drive roller 33 and rotate following the circular carriage of the transfer belt 31. In this example, the driven roller 34 is disposed in the upstream side of the four development units 14 in the carrying direction F.

The cleaning blade 35 is configured so as to be in contact with the transfer target face of the transfer belt 31 and perform cleaning by scraping off toner adhering to the transfer target face of the transfer belt 31.

The cleaner container 36 is configured so as to contain toner scraped off the transfer target face of the transfer belt 31 by the cleaning blade 35.

The fuser part 40 is configured so that the toner image transferred onto a sheet 9 is fused to the sheet 9 by giving heat and a pressure to the sheet 9. The fuser part 40 has a heat roller 41, a temperature sensor 43, and a pressure application roller 44.

The heat roller 41 is configured so as to give heat to toner on the sheet 9. The heat roller 41 is designed to rotate clockwise in this example by a power transmitted from a heater motor 65 (mentioned below). The heat roller 41 has a heater 42. The heater 42 is configured, for example, using a halogen heater. The temperature sensor 43 is configured, for example, using a thermistor so as to detect the surface temperature of the heat roller 41. The pressure application roller 44 is configured so as to be pressed against the heat roller 41 with a changeable amount of pressing force. Thereby, in the fuser part 40, a nip section N is formed between the heat roller 41 and the pressure application roller 44, and toner on the sheet 9 is heated, melted, and pressed. As a result, the toner image is fused onto the sheet 9.

The medium sensor 17 is disposed in the downstream side of the fuser part 40 and is configured so as to detect the passage of the sheet 9 outputted from the fuser part 40. The medium sensor 17 is designed to supply the detection result to the printer engine control part 67 (mentioned below).

The medium guide 18 is configured so as to guide the sheet 9 outputted from the fuser part 40 along the carrying route 10 to the outside of the image forming apparatus 1.

By this configuration, the image forming apparatus 1 forms images on the sheets 9. Then, the sheets 9 having the images formed are designed to be stacked on an ejection tray 19.

Figure 3:
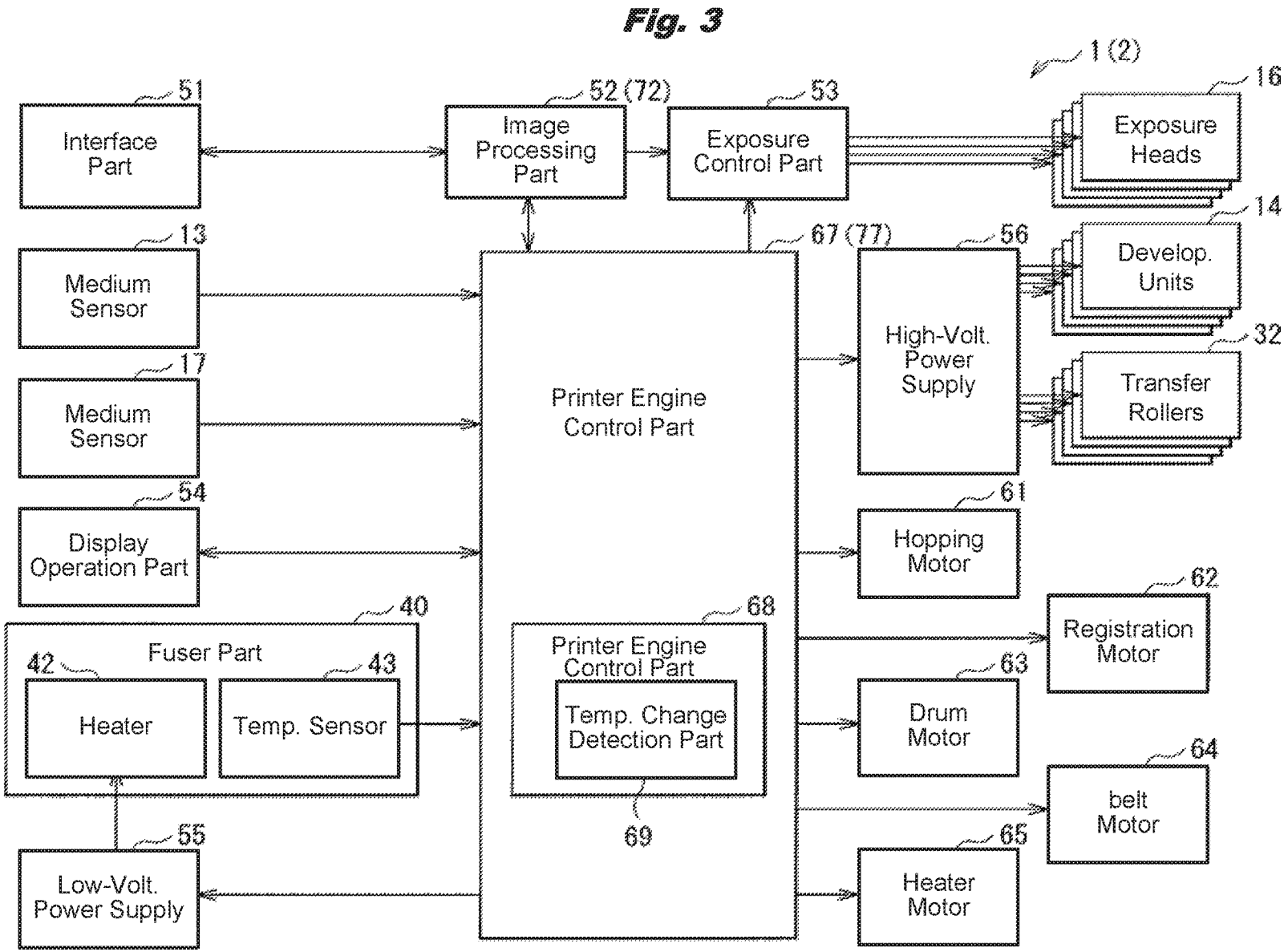
FIG. 3 is a block diagram showing an example of the control mechanism of an image forming apparatus of the first embodiment.

FIG. 3 shows an example of the control mechanism of the image forming apparatus 1. The image forming apparatus 1 has an interface part 51, an image processing part 52, an exposure control part 53, a display operation part 54, a low-voltage power supply 55, the high-voltage power supply 56, the hopping motor 61, the registration motor 62, the drum motor 63, the belt motor 64, the heater motor 65, and the printer engine control part 67.

The interface part 51 is configured, for example, so as to receive print data DP described in a PDL (Page Description Language) or the like from an unshown host computer, and exchange various control signals with this host computer.

The image processing part 52 is configured so as to notify the printer engine control part 67 that the image forming apparatus 1 has received the print data DP, and generate bitmap data by performing a prescribed process based on the print data DP supplied from the interface part 51 according to an instruction from the printer engine control part 67. Also, as mentioned below, the image processing part 52 also has a function to calculate image densities D in four edge regions R of a page image PIC based on this bitmap data and change the orientation of the page image PIC based on the calculation result, thereby correcting the bitmap data. The image processing part 52 is configured, for example, using a processor and RAM (Random Access Memory).

The exposure control part 53 is configured so as to control the operations of the four exposure heads 16 (exposure heads 16K, 16Y, 16M, and 16C) according to an instruction from the printer engine control part 67 and the bitmap data supplied from the image processing part 52.

The display operation part 54 is configured so as to accept user's operations and also display the operation state of the image forming apparatus 1 and instructions to the user. The display operation part 54 is configured, for example, using a liquid-crystal display, a touch panel, various indicators, various buttons, etc.

The low-voltage power supply 55 is configured so as to supply an electric power to the heater 42 of the fuser part 40 according to an instruction from the printer engine control part 67.

The high-voltage power supply 56 is configured so as to generate the charging voltages to be applied to the charging rollers 24 of the development units 14K, 14Y, 14M, and 14C, the development voltages to be applied to the development rollers 26 of the development units 14K, 14Y, 14M, and 14C, the supply voltages to be applied to the supply rollers 28 of the development units 14K, 14Y, 14M, and 14C, and the transfer voltages to be applied to the transfer rollers 32K, 32Y, 32M, and 32C according to instructions from the printer engine control part 67.

The hopping motor 61 is configured so as to generate a power to be transmitted to the hopping roller 11 (FIG. 1) according to an instruction from the printer engine control part 67. The registration motor 62 is configured so as to generate a power to be transmitted to the registration roller 12 according to an instruction from the printer engine control part 67. The drum motor 63 is configured so as to generate powers to be transmitted to the four development units 14 according to instructions from the printer engine control part 67. The belt motor 64 is configured so as to generate a power to be transmitted to the drive roller 33 according to an instruction from the printer engine control part 67. The heater motor 65 is configured so as to generate a power to be transmitted to the heat roller 41 according to an instruction from the printer engine control part 67.

The printer engine control part 67 is configured so as to control individual blocks of the image forming apparatus 1. Specifically, the printer engine control part 67 controls the image processing part 52 to generate bitmap data based on the print data DP. Then, the printer engine control part 67 controls the low-voltage power supply 55 to supply an electric power to the heater 42 of the fuser part 40 and also adjust the electric power to be supplied to the heater 42 based on the detection result in the temperature sensor 43. Also, based on information on the kind of recording medium contained in the print data DP, the printer engine control part 67 controls the amount of pressing force of the pressure application roller 44 to the heat roller 41 in the fuser part 40. Then, the printer engine control part 67 controls the hopping motor 61 to rotate the hopping roller 11, controls the registration motor 62 to rotate the registration roller 12, controls the drum motor 63 to rotate the photosensitive drum 21, the development roller 26, and the supply roller 28 in each of the four development units 14, controls the belt motor 64 to rotate the drive roller 33, and controls the heater motor 65 to rotate the heat roller 41. Also, based on the detection result in the medium sensor 13, the printer engine control part 67 controls the high-voltage power supply 56 to generate various voltages. Also, based on the detection result in the medium sensor 13, the printer engine control part 67 controls the operation of the exposure control part 53 to operate the four exposure heads 16. Also, the printer engine control part 67 is designed to detect winding of a sheet 9 in the fuser part 40 based on the detection result in the medium sensor 17 and the detection result in the temperature sensor 43.

The printer engine control part 67 has a winding detection part 68. The winding detection part 68 is configured so as to detect winding of a sheet 9 in the fuser part 40 based on the detection result in the medium sensor 17 and the detection result in the temperature sensor 43. The winding detection part 68 has a temperature change detection part 69. This temperature change detection part 69 is configured so as to detect temperature changes in the temperature sensor 43. The winding detection part 68 is designed to detect winding of a sheet 9 in the fuser part 40 based on information on the temperature change detected by the temperature change detection part 69.

Next, the operation of this winding detection part 68 is explained.

Figure 4A:
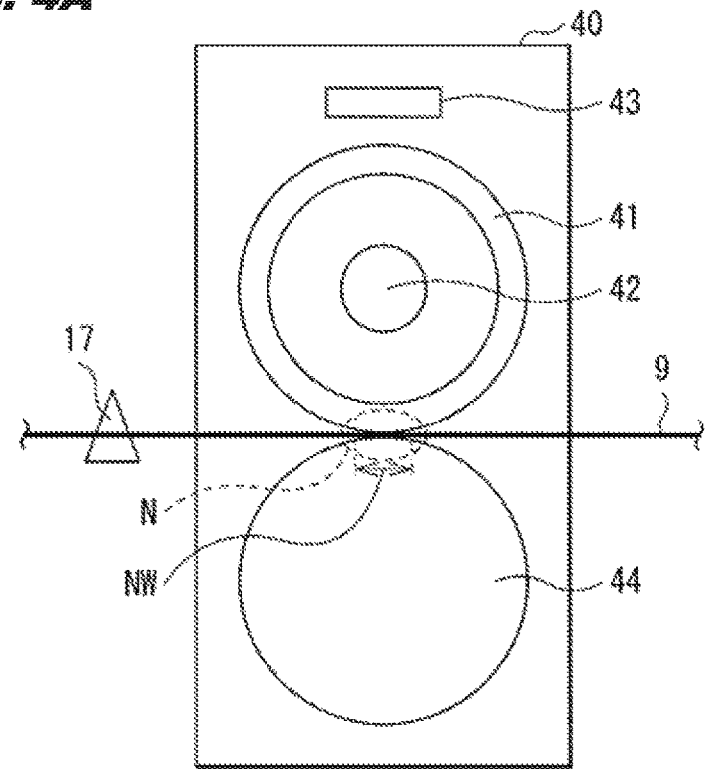
FIG. 4A is an explanatory diagram showing an operation state of a fuser part shown in FIG. 1.
Figure 4B:
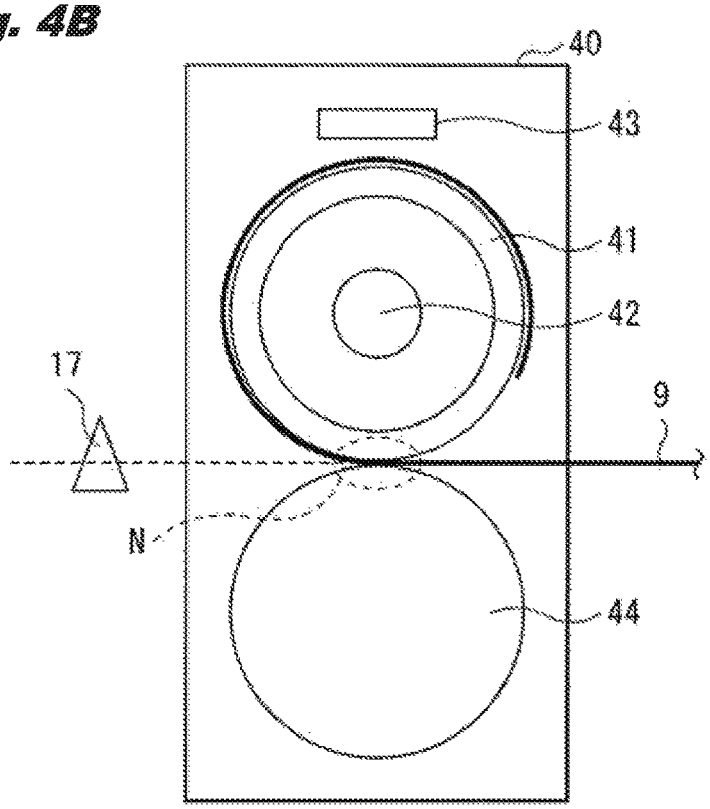
FIG. 4B is an explanatory diagram showing another operation state of the fuser part shown in FIG. 1.

FIG. 4A shows an operation example of the fuser part 40 during the normal operation, and FIG. 4B shows an operation example of the fuser part 40 when winding has occurred.

A sheet 9 having a toner image transferred by the transfer part 30 passes through the nip section N between the heat roller 41 and the pressure application roller 44. The width of this nip section N (nip width NW) varies according to the amount of pressing force of the pressure application roller 44 to the heat roller 41. The nip width is measured in a carrying direction, not in a lateral direction of sheet, see Arrow F in FIG. 1. That is, if the amount of pressing force is large, the nip width NW becomes large, and if the amount of pressing force is small, the nip width NW becomes small. Then, by passing through this nip section N, toner on the sheet 9 is heated, melted, and pressed, and as a result the toner image is fused onto the sheet 9. During the normal operation, as shown in FIG. 4A, after passing through this nip section, the sheet 9 is carried along the carrying route 10 and passes through the medium sensor 17.

On the other hand, if the toner density is high near the leading edge in the carrying direction F of the sheets 9, or if the sheet 9 is thin, as shown in FIG. 4B, the sheet 9 may wind around the heat roller 41. That is, in this case, by the toner on the sheet 9 melting in the nip section N, the sheet 9 becomes easy to contact tightly with the heat roller 41, thereby the sheet 9 winds around the heat roller 41. If the sheet 9 winding around it in this manner reaches a point between the temperature sensor 43 and the heat roller 41 as shown in FIG. 4B, temperature detected by the temperature sensor 43 changes. By detecting this change in temperature, the temperature change detection part 69 of the winding detection part 68 detects that the sheet 9 has wound around the heat roller 41.

Figure 5:
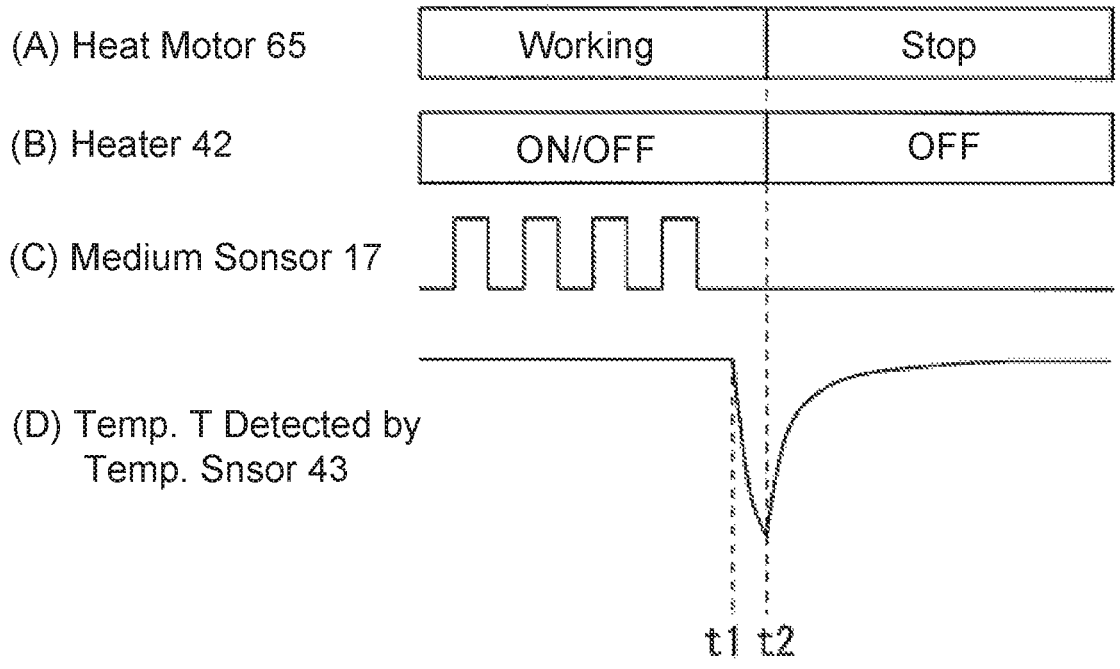
FIG. 5 is a timing chart showing an operation example of a winding detection part shown in FIG. 3.

FIG. 5 shows the operation of the image forming apparatus 1 in detecting winding, where (A) shows the operation of the heat motor 65, (B) shows the operation of the heater 42, (C) shows the output signal of the medium sensor 17, and (D) shows temperature T detected by the temperature sensor 43. In FIG. 5C, a high level indicates that a sheet 9 is passing through the medium sensor 17, and a low level indicates that no sheet 9 is passing through the medium sensor 17.

In this example, the image forming apparatus 1 forms images on multiple sheets 9. The printer engine control part 67 operates the hopping motor 61, the registration motor 62, the drum motor 63, the belt motor 64, and the heater motor 65 (FIG. 5A), and turns on/off the heater 42 so that temperature T maintains prescribed temperature (FIG. 5B). The medium sensor 17 detects the passages of multiple sheets 9 (FIG. 5C).

Then, a sheet 9 among the multiple sheets 9 winds around the heat roller 41, and the leading edge of the wound recording medium 9 reaches near the temperature sensor 43 at timing t1. Thereby, because the sheet 9 passes between the temperature sensor 43 and the heat roller 41, the temperature sensor 43 becomes unable to detect directly temperature of the heat roller 41, thereby temperature T rapidly decreases (FIG. 5D). In this manner, if a sheet 9 has wound around the heat roller 41, because the medium sensor 17 does not detect the passage of the sheet 9, its output signal maintains the low level (FIG. 5C). Based on the output signal of the medium sensor 17, at timing t2, the printer engine control part 67 stops the operations of the hopping motor 61, the registration motor 62, the drum motor 63, the belt motor 64, and the heater motor 65 (FIG. 5A), and also turns off the heater 42 (FIG. 5B). In the transfer part 30, after this timing t2, because the heat roller 41 and the pressure application roller 44 stop rotating, heat on the heat roller 41 becomes hard to be transmitted to the pressure application roller 44 and dissipate. Therefore, temperature T increases after this timing t2.

The temperature change detection part 69 of the winding detection part 68 detects a temperature variation slope when temperature T decreases during a period of timing t1-t2. Then, based on this temperature variation slope and time the temperature variation slope continued, the winding detection part 68 specifies that the temperature T decrease detected by the temperature sensor 43 is caused by the fact that the sheet 9 has wound around the heat roller 41. In this manner, the winding detection part 68 is designed to detect the fact that the sheet 9 has wound around the heat roller 41.

As mentioned below, by this configuration, the image forming apparatus 1 generates bitmap data based on the print data DP, calculates the image densities D in the four edge regions R of the page image PIC based on the bitmap data, and corrects the bitmap data by changing the orientation of the page image PIC based on the calculation result. Then, based on this bitmap data, the image forming apparatus 1 forms an image on a sheet 9. Thereby, the image forming apparatus 1 is designed to be able to reduce the possibility that a sheet 9 winds around the heat roller 41.

Here, the interface part 51 corresponds to a specific example of the "receiving part" in this invention. The image processing part 52 corresponds to a specific example of the "image processing part" in this invention. The hopping roller 11, the registration roller 12, and the fuser part 40 correspond to a specific example of the "medium carrying part" in this invention. The development units 14 correspond to a specific example of the "image forming part" in this invention.

[Operations and Actions]

Subsequently, explained are the operations and actions of the image forming apparatus 1 of this embodiment.

(Overall Operation Outline) First of all, referring to FIGS. 1-3, the overall operation outline of the image forming apparatus 1 is explained. In the image forming apparatus 1, once the interface part 51 has received the print data DP from the host computer, first the image processing part 52 generates bitmap data based on the print data DP according to an instruction from the printer engine control part 67. Then, based on this bitmap data, the image processing part 52 calculates the image densities D in the four edge regions R of the page image PIC, and corrects the bitmap data by changing the orientation of the page image PIC based on the calculation results. The low-voltage power supply 55 supplies an electric power to the heater 42 of the fuser part 40 according to an instruction from the printer engine control part 67. Once temperature of the fuser part 40 detected by the temperature sensor 43 has reached the temperature fit for a fusing operation, the printer engine control part 67 lets an image forming operation start.

In the print operation, first, the hopping motor 61 rotates the hopping roller 11 according to an instruction from the printer engine control part 67, and the registration motor 62 rotates the registration roller 12 according to an instruction from the printer engine control part 67. Thereby, a sheet 9 is extracted from the medium containing part 8, and the extracted sheet 9 is carried along the carrying route 10.

Then, the drum motor 63 rotates the photosensitive drum 21, the development roller 26, and the supply roller 28 of each of the four development units 14 according to instructions from the printer engine control part 67, and the belt motor 64 rotates the drive roller 33 according to an instruction from the printer engine control part 67. According to an instruction from the printer engine control part 67, the high-voltage power supply 56 generates the charging voltages to be applied to the charging rollers 24 in the four development units 14, the development voltages to be applied to the development rollers 26 of the four development units 14, the supply voltages to be applied to the supply rollers 28 of the four development units 14, and the transfer voltages to be applied to the four transfer rollers 32, respectively. According to an instruction from the printer engine control part 67 and based on the bitmap data supplied from the image processing part 52, the exposure control part 53 controls the operations of the four exposure heads 16. Thereby, first an electrostatic latent image is formed on the surface of the photosensitive drum 21 of each development unit 14, and afterwards a toner image is formed according to the electrostatic latent image. Then, the toner image on the photosensitive drum 21 of each development unit 14 is transferred onto the transfer target face of the sheet 9.

The heater motor 65 rotates the heat roller 41 according to an instruction from the printer engine control part 67. Thereby, in the fuser part 40, toner on the sheet 9 is heated, melted, and pressed. As a result, the toner image is fused onto the sheet 9.

(Detailed Operations) In the image forming apparatus 1, the image processing part 52 generates bitmap data based on the print data DP, calculates the image densities D in the four edge regions R of the page image PIC based on the bitmap data, and changes the orientation of the page image PIC based on the calculation result, thereby correcting the bitmap data. Then, based on this bitmap data, the image forming apparatus 1 forms an image on the sheet 9. Below, this operation is explained in detail.

Figure 6:
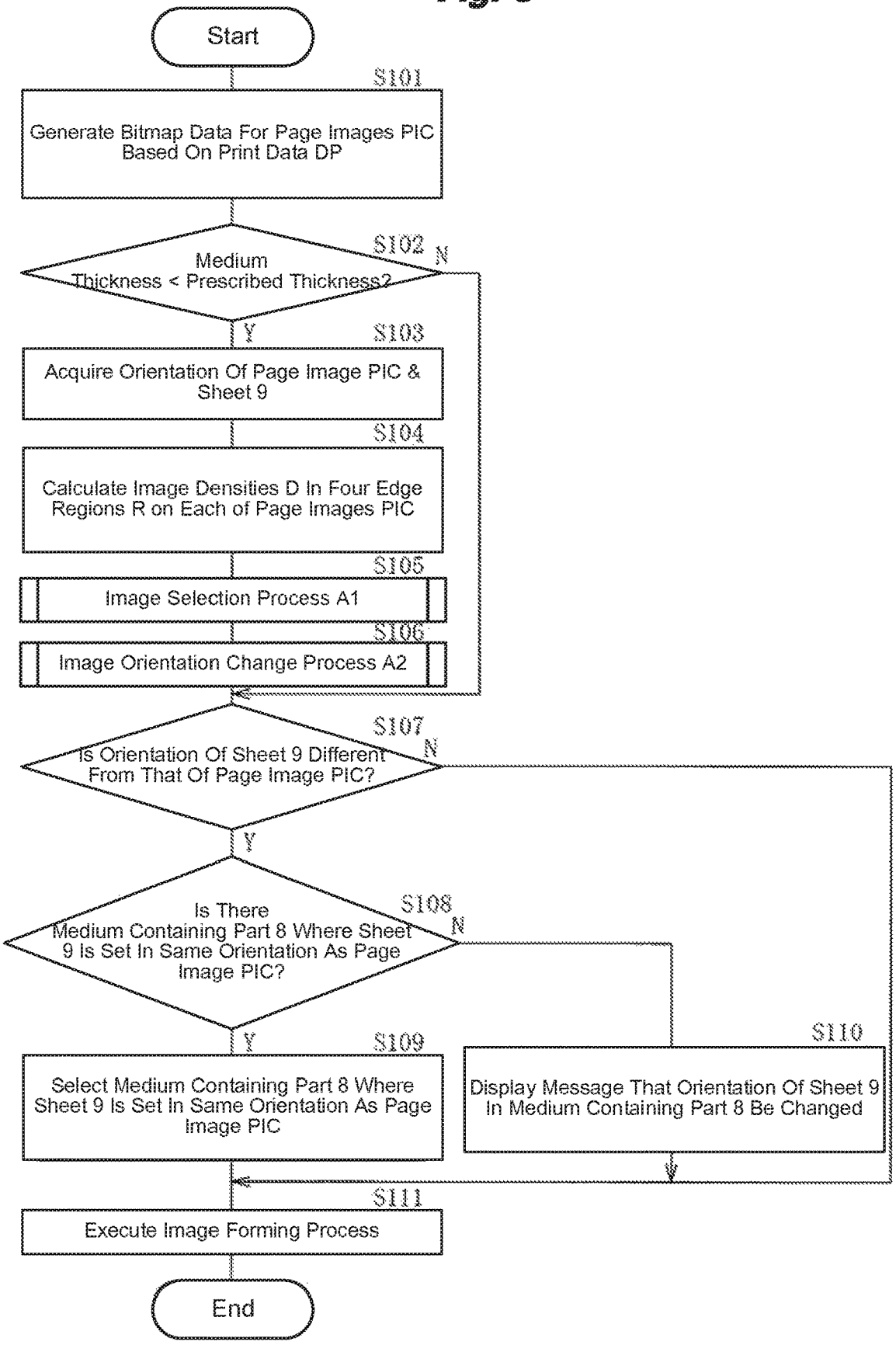
FIG. 6 is a flow chart showing an operation example of the image forming apparatus of the first embodiment.

FIG. 6 shows an example of the operations of the image forming apparatus 1. In this example, the print data DP supplied from the host computer contains information on multiple page images PIC and the thickness of a sheet 9 (medium thickness). Based on such print data DP, the image processing part 52 generates bitmap data. Then, based on the image densities D in the four edge regions R on each of the multiple page images PIC, the image processing part 52 selects one page image PIC from the multiple page images PIC. Then, based on the image densities D in the four edge regions R of the selected page image PIC, the image processing part 52 changes the orientations of the multiple page images PIC, thereby correcting the bitmap data. Then, based on the corrected bitmap data, the image forming apparatus 1 forms images on the sheets 9. Below, this operation is explained in detail.

First, based on the print data DP described in a PDL for example, the image processing part 52 performs a prescribed process to generate bitmap data for multiple page images PIC (S101).

Next, the image processing part 52 acquires information on the thickness of a sheet 9 (medium thickness) contained in the print data DP and checks whether the medium thickness is smaller than a prescribed thickness (S102). The medium thickness can be the thickness itself or weight for example. If the medium thickness is no smaller than the prescribed thickness ("N" in S102), the system proceeds to S107. That is, in this case, because the sheet 9 is thick, the possibility that winding occurs is low. Therefore, it proceeds to S107 without going through S103-S106.

In S102, if the medium thickness is smaller than the prescribed thickness ("Y" in S102), the image processing part 52 acquires information on the orientations of the sheet 9 and the page image PIC (S103).

Figure 7:
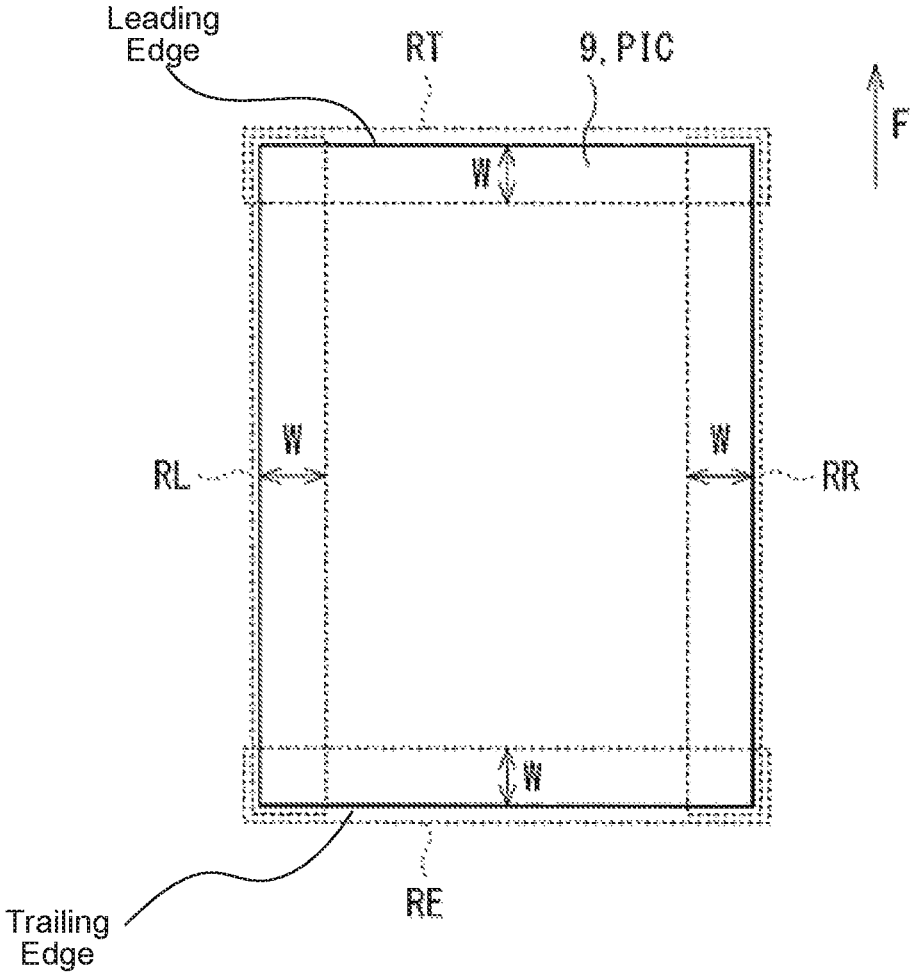
FIG. 7 is an explanatory diagram showing an example of edge regions of a page image.

FIG. 7 shows an example of the orientations of the sheet 9 and the page image PIC. In this example, the sheet 9 is initially set in the portrait orientation in the medium containing part 8. Thereby, the sheet 9 is carried along the carrying route 10 keeping its longitudinal orientation to the carrying direction F. That is, the extending direction of the long side of the sheet 9 (longitudinal direction in FIG. 7) is the same direction as the carrying direction F, and the extending direction of the short side of the sheet 9 (lateral direction in FIG. 7) is the direction intersecting with the carrying direction F. The page image PIC is formed on this sheet 9. Therefore, the orientation of the page image PIC is also longitudinal to the carrying direction F.

Next, based on the bitmap data generated in S101, the image processing part 52 calculates the image densities D in the four edge regions R on each of the multiple page images PIC (S104).

As shown in FIG. 7, the four edge regions R are regions corresponding to four sides of the page image PIC, including a leading edge region RT, a trailing edge region RE, a left edge region RL, and a right edge region RR. The leading edge region RT is a partial region included in the page image PIC, disposed near the leading edge of the sheet 9 carried in the carrying direction F, and the trailing edge region RE is a partial region included in the page image PIC, disposed near the trailing edge of the sheet 9 carried in the carrying direction F. The left edge region RL is a partial region included in the page image PIC, disposed near the left edge of the sheet 9, and the right edge region RR is a partial region included in the page image PIC, disposed near the right edge of the sheet 9. The leading edge region RT, the trailing edge region RE, the left edge region RL, and the right edge region RR are band-shaped regions having a width W. This width W is about the same as the nip width NW in the fuser part 40 (FIG. 4A).

Based on the bitmap data generated in S101, the image processing part 52 calculates the image densities D in the four edge regions R on each of the multiple page images PIC. The image densities D include a leading edge density DT, a trailing edge density DE, a left edge density DL, and a right edge density DR. The leading edge density DT is the image density D in the leading edge region RT, the trailing edge density DE is the image density D in the trailing edge region RE, the left edge density DL is the image density D in the left edge region RL, and the right edge density DR is the image density D in the right edge region RR. The image processing part 52 can calculate the image densities D in the four edge regions R using software for example. Also, if the exposure control part 53 has hardware to calculate dot counts, the image processing part 52 can utilize this hardware of the exposure control part 53 to calculate the image densities D in the four edge regions R.

Next, the image processing part 52 performs an image selection process A1 (S105).

Figure 8:
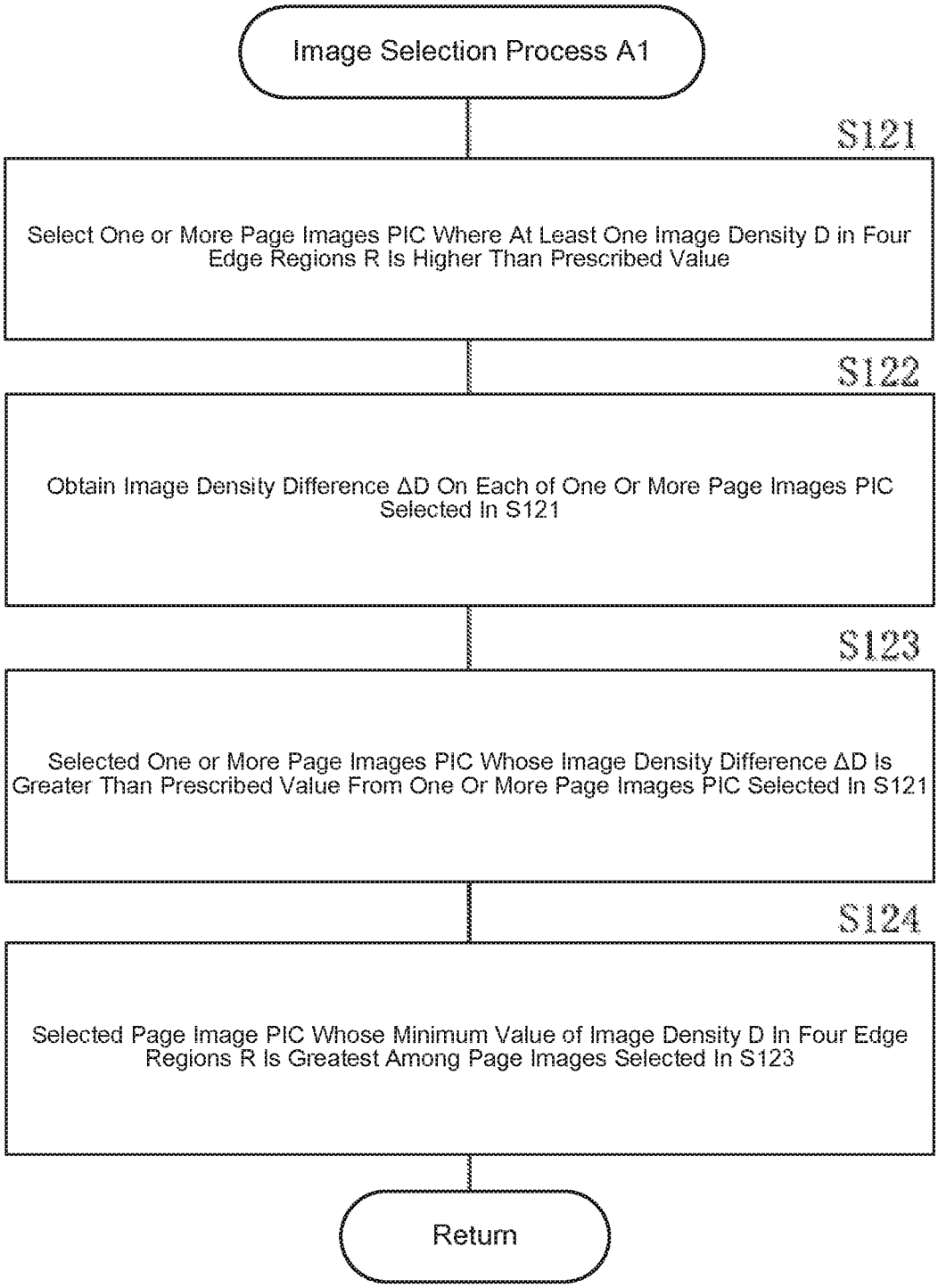
FIG. 8 is a flow chart showing an example of an image selection process shown in FIG. 6.

FIG. 8 shows an example of subroutines of the image selection process A1. Based on the image densities D in the four edge regions R on each of the multiple page images PIC, the image processing part 52 selects from the multiple page images PIC one page image PIC to be used in determining the orientations of the multiple page images PIC. Below, this operation is explained in detail.

First, the image processing part 52 selects from the multiple page images PIC at least one page image PIC (or one or more page images PIC) where at least one image density D in the four edge regions R is higher than a prescribed value (S121). That is, the image processing part 52 excludes page images PIC whose image densities D in the four edge regions R are all smaller than the prescribed value.

Next, the image processing part 52 obtains the difference between the maximum value and the minimal value among the image densities D (image density difference ΔD) in the four edge regions R on each of the at least one page image PIC selected in S121 (S122).

Next, the image processing part 52 selects from the at least one page image PIC selected in S121 at least one page image PIC whose image density difference ΔD is greater than a prescribed value (S123). That is, the image processing part 52 excludes page images PIC whose difference among the image densities D in the four edge regions R is smaller than the prescribed value.

Next, the image processing part 52 selects from the at least one page image PIC selected in S123 (or more than one page images) one page image PIC whose a minimum value of the image densities D in the four edge regions R is the greatest among the page images selected in S123 (S124).

Below, the operations of the image forming apparatus 1 are explained specifically in two cases C1 and C2 as examples.

Figure 9:
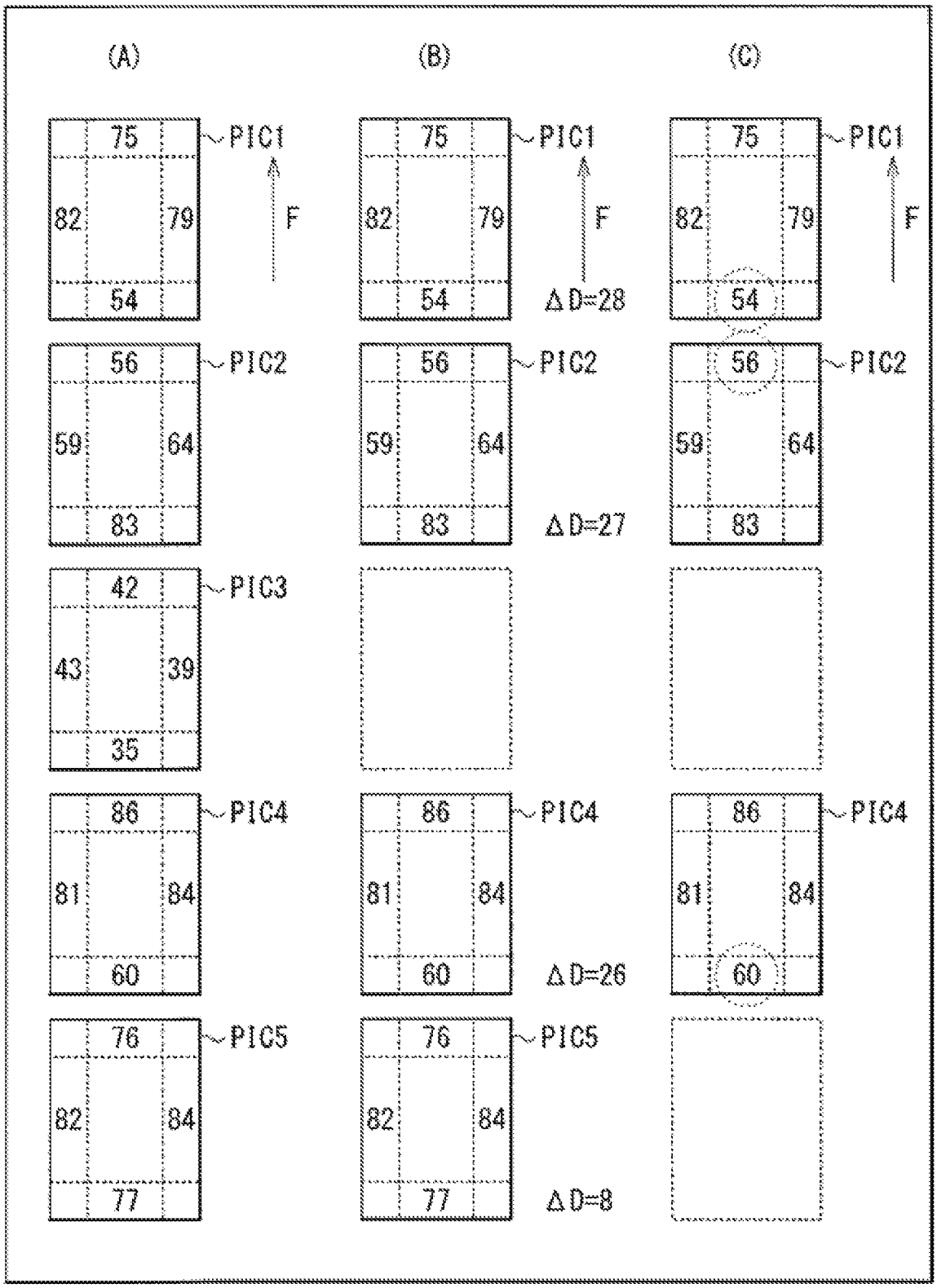
FIG. 9 is an explanatory diagram showing an example of image densities in the edge regions shown in FIG. 7.

FIG. 9 shows an example of the image selection process A1 in the case C1. In this example, the print data DP contains five page images PIC (page images PIC1-PIC5). Based on the page images PIC1, PIC2, PIC3, PIC4, and PIC5, the image forming apparatus 1 forms images on sheets 9 in this order. In FIG. 9, numerical values indicate image densities D on the five page images PIC1-PIC5. In S104, the image processing part 52 obtains the image densities D shown in FIG. 9A.

In S121, the image processing part 52 selects from these five page images PIC at least one page image PIC where at least one image density D in the four edge regions R is higher than a prescribed value. In this example, this prescribed value is "50". Therefore, in this example, as shown in FIG. 9B, the four page images PIC1, PIC2, PIC4, and PIC5 are selected. That is, because the image densities D in the four edge regions R are all no higher than "50" on the page image PIC3, it is excluded.

Next, in S122, the image processing part 52 obtains the difference between the maximum value and the minimum value of the image densities D in the four edge regions R (image density difference ΔD) on each of the four page images PIC1, PIC2, PIC4, and PIC5 (S122). Then, in S123, the image processing part 52 selects from the four page images PIC1, PIC2, PIC4, and PIC5 at least one page image PIC whose image density difference ΔD is greater than a prescribed value. In this example, this prescribed value is "10". As shown in FIG. 9B, the image density difference ΔD on the page image PIC1 is "28", the image density difference ΔD on the page image PIC2 is "27", the image density difference ΔD on the page image PIC4 is "26", and the image density difference ΔD on the page image PIC5 is "8". Therefore, in this example, as shown in FIG. 9C, the three page images PIC1, PIC2, and PIC4 are selected. That is, because the image density difference ΔD is no greater than "10" on the page image PIC5, it is excluded.

Next, in S124, the image processing part 52 selects from the three page images PIC1, PIC2, and PIC4 a page image PIC having the greatest minimum value of the image density D in the four edge regions R. As shown in FIG. 9C, the minimum value of the image density D on the page image PIC1 is "54", the minimum value of the image density D on the page image PIC2 is "56", and the minimum value of the image density D on the page image PIC4 is "60". Therefore, in this example, the page image PIC4 is selected.

Figure 10:
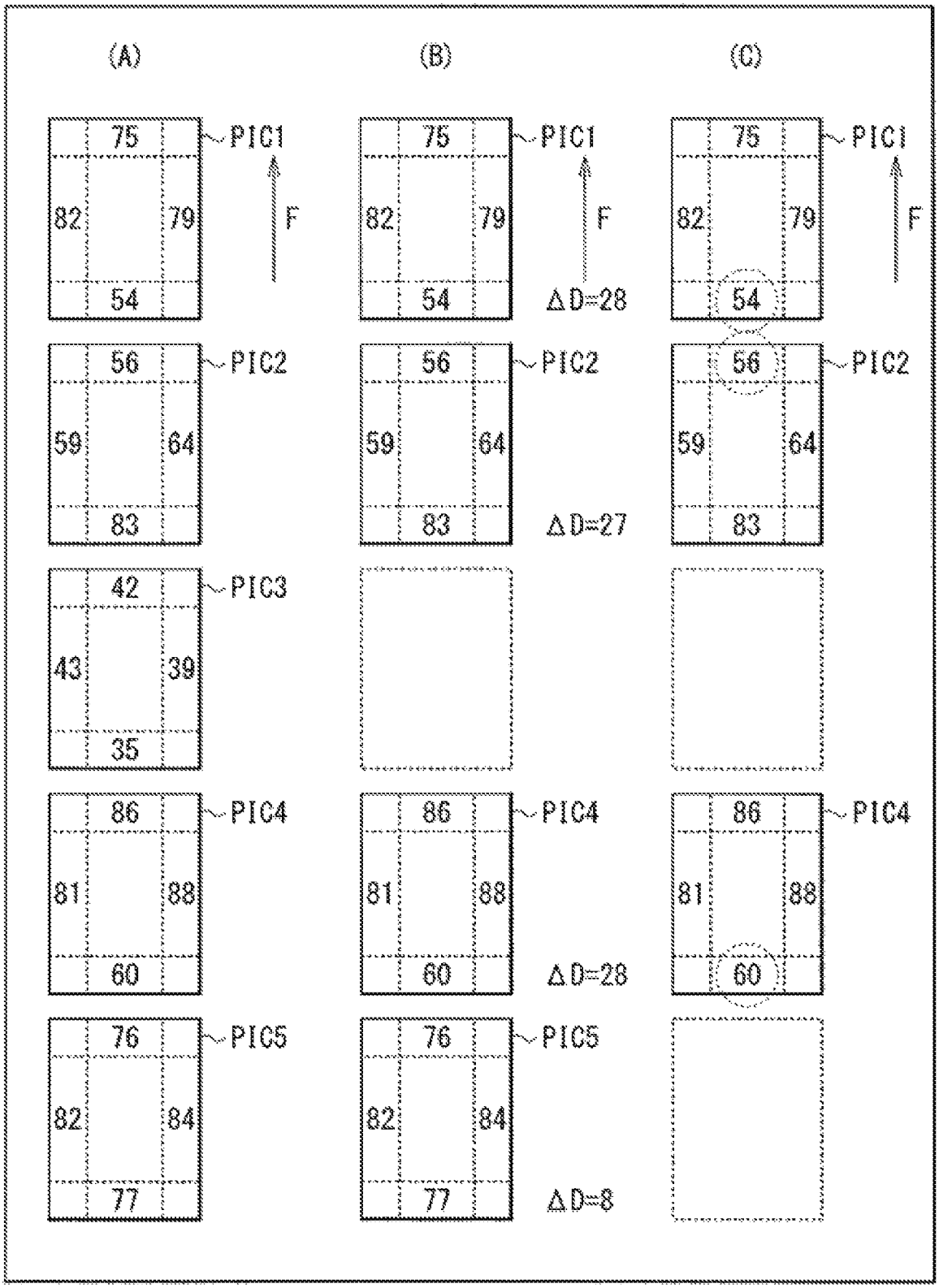
FIG. 10 is an explanatory diagram showing another example of image densities in the edge regions shown in FIG. 7.

FIG. 10 shows an example of the image selection process A1 in the case C2. In this example, the image density D on the page image PIC4 is set to a different value from that in the case C1. The image densities D on the page images PIC1-PIC3 and PIC5 are the same as in the case C1. In this case also, in the same manner as in the case C1, the four page images PIC1, PIC2, PIC4, and PIC5 are selected in S121, the three page images PIC1, PIC2, and PIC4 are selected in S122 and S123, and the page image PIC4 is selected in S124.

Here, this subroutine ends.

Next, as shown in FIG. 6, the image processing part 52 performs an image orientation changing process A2 (S105).

Figure 11:
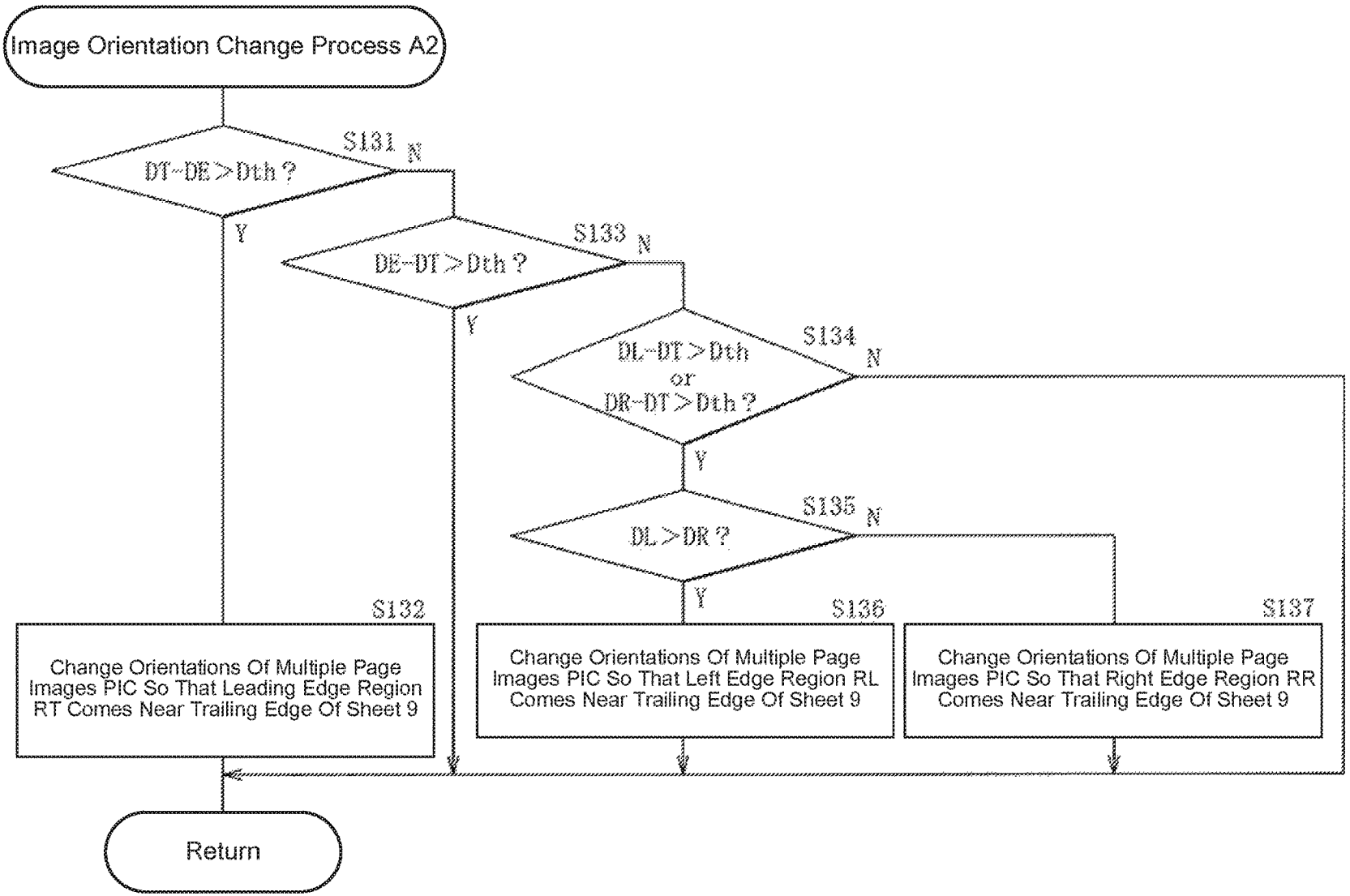
FIG. 11 is a flow chart showing an example of an image orientation changing process shown in FIG. 6.

FIG. 11 shows an example of subroutines of the image orientation changing process A2. Based on the image densities D in the four edge regions R on the page image PIC selected in S124, the image processing part 52 changes the orientations of the multiple page images PIC contained in the print data DP, thereby correcting the bitmap data. Below, this operation is explained in detail.

First, the image processing part 52 checks whether the difference between the leading edge density DT and the trailing edge density DE on the page image PIC selected in S124 is greater than a prescribed threshold Dth (DT−DE>Dth) (S131). Here, the prescribed threshold has a positive value.

In S131, if the difference between the leading edge density DT and the trailing edge density DE is greater than the prescribed threshold Dth ("Y" in S131), the image processing part 52 changes the orientations of the multiple page images PIC so that the leading edge region RT comes near (or at) the trailing edge of the sheet 9 (S132). That is, in this case, because the leading edge density DT is higher than the trailing edge density DE, if the leading edge region RT is disposed near the leading edge of the sheet 9, the sheet 9 may wind around the heat roller 41. Therefore, the image processing part 52 changes the orientations of the multiple page images PIC so as to dispose the leading edge region RT near the trailing edge of the sheet 9. In this case, the orientation of the page images PIC is, for example, longitudinal to the carrying direction F of the sheets 9. Then, this subroutine ends.

In S131, if the difference between the leading edge density DT and the trailing edge density DE is no greater than the threshold Dth ("N" in S131), the image processing part 52 checks whether the difference between the trailing edge density DE and the leading edge density DT on the page image PIC is greater than the prescribed threshold Dth (DE−DT>Dth) (S133).

In S133, if the difference between the trailing edge density DE and the leading edge density DT is greater than the prescribed threshold Dth ("Y" in S133), this subroutine ends. That is, in this case, because the leading edge density DT is lower than the trailing edge density DE, if the leading edge region RT is disposed near the leading edge of the sheet 9, the possibility that the sheet 9 winds around the heat roller 41 is low. Therefore, the image processing part 52 does not change the orientations of the multiple page images PIC. In this case, the orientation of the page images PIC is, for example, longitudinal to the carrying direction F of the sheets 9.

In S133, if the difference between the trailing edge density DE and the leading edge density DT is no greater than the prescribed threshold Dth ("N" in S133), the image processing part 52 checks whether either the difference between the left edge density DL and the leading edge density DT is greater than the prescribed threshold Dth (DL−DT>Dth) or the difference between the right edge density DR and the leading edge density DT is greater than the prescribed threshold Dth (DR−DT>Dth) (S134).

In S134, if the difference between the left edge density DL and the leading edge density DT is no greater than the prescribed threshold Dth and the difference between the right edge density DR and the leading edge density DT is no greater than the prescribed threshold Dth ("N" in S134), this subroutine ends. That is, in this case, the leading edge density DT is about the same as the trailing edge density DE, and both the left edge density DL and the right edge density DR are about the same as or lower than the leading edge density DT, therefore if the leading edge region RT is disposed near the leading edge of the sheet 9, the possibility that the sheet 9 winds around the heat roller 41 is low. Therefore, the image processing part 52 does not change the orientations of the multiple page images PIC. In this case, the orientation of the page images PIC is, for example, longitudinal to the carrying direction F of the sheets 9.

In S134, if either the difference between the left edge density DL and the leading edge density DT is greater than the prescribed threshold Dth or the difference between the right edge density DR and the leading edge density DT is greater than the prescribed threshold Dth ("Y" in S134), the image processing part 52 checks whether the left edge density DL is higher than the right edge density DR (DL>DR) (S135).

In S135, if the left edge density DL is higher than the right edge density DR ("Y" in S135), the image processing part 52 changes the orientations of the multiple page images PIC so that the left edge region RL comes near (or at) the trailing edge of the sheet 9 (S136). That is, in this case, because the left edge density DL is higher than the right edge density DR, if the left edge region RL is disposed near the leading edge of the sheet 9, the sheet 9 may wind around the heat roller 41. Therefore, the image processing part 52 changes the orientations of the multiple page images PIC so as to dispose the left edge region RL near the trailing edge of the sheet 9. In this case, the orientation of the page images PIC is, for example, lateral to the carrying direction F of the sheets 9. Then, this subroutine ends.

In S135, if the left edge density DL is no higher than the right edge density DR ("N" in S135), the image processing part 52 changes the orientations of the multiple page images PIC so that the right edge region RR comes near the trailing edge of the sheet 9 (S137). That is, in this case, because the right edge density DR is higher than the left edge density DL, if the right edge region RR is disposed near the leading edge of the sheet 9, the sheet 9 may wind around heat roller 41. Therefore, the image processing part 52 changes the orientations of the multiple page images PIC so as to dispose the right edge region RR near the trailing edge of the sheet 9. In this case, the orientation of the page images PIC is, for example, lateral to the carrying direction F of the sheets 9. Then, this subroutine ends.

Next, as shown in FIG. 6, the image processing part 52 checks whether the orientation of the sheet 9 set in the medium containing part 8 is different from the orientation of the page image PIC (S107). That is, in this example, as shown in FIG. 7, the orientation of the sheet 9 set in the medium containing part 8 is longitudinal to the carrying direction F of the sheets 9. On the other hand, the orientation of the page image PIC is longitudinal or lateral to the carrying direction F by the image orientation changing process A2. Therefore, the image processing part 52 checks whether the orientation of the sheet 9 is different from the orientation of the page image PIC.

In S107, if the orientation of the sheets 9 in the medium containing part 8 matches with the orientation of the page image PIC ("N" in S107), the system proceeds to S111.

In S107, if the orientation of the sheets 9 in the medium containing part 8 is different from the orientation of the page image PIC ("Y" in S107), the printer engine control part 67 checks whether there is a medium containing part 8 where sheets 9 are set in the same orientation as the orientation of the page image PIC (S108). That is, if multiple medium containing parts 8 are installed in the image forming apparatus 1 for example, there can be a medium containing part 8 where sheets 9 are set in the same orientation as the orientation of the page image PIC, therefore the printer engine control part 67 checks whether there is such a medium containing part 8.

In S108, if there is a medium containing part 8 where sheets 9 are set in the same orientation as the orientation of the page image PIC ("Y" in S108), the printer engine control part 67 selects the medium containing part 8 where sheets 9 are set in the same orientation as the orientation of the page image PIC as the supply source of the sheet 9 (S109).

In S108, if there is no medium containing part 8 where sheets 9 are set in the same orientation as the orientation of the page image PIC ("N" in S108), according to an instruction from the printer engine control part 67, the display operation part 54 displays a message notifying the user that the orientation of the sheets 9 in the medium containing part 8 should be changed (S110). Following this message, for example, the user changes the orientation of the sheets 9 in the medium containing part 8. Also, if the image forming apparatus 1 has a manual-feed tray, the sheet 9 with a desired orientation may be set onto this manual-feed tray. Thereby, the orientation of the sheet 9 matches with the orientation of the page image PIC.

Then, the image forming apparatus 1 forms images on the sheets 9 based on the multiple page images PIC (S111). Or, it means that the image forming process is executed. S12

Here, this flow ends.

Figure 12:
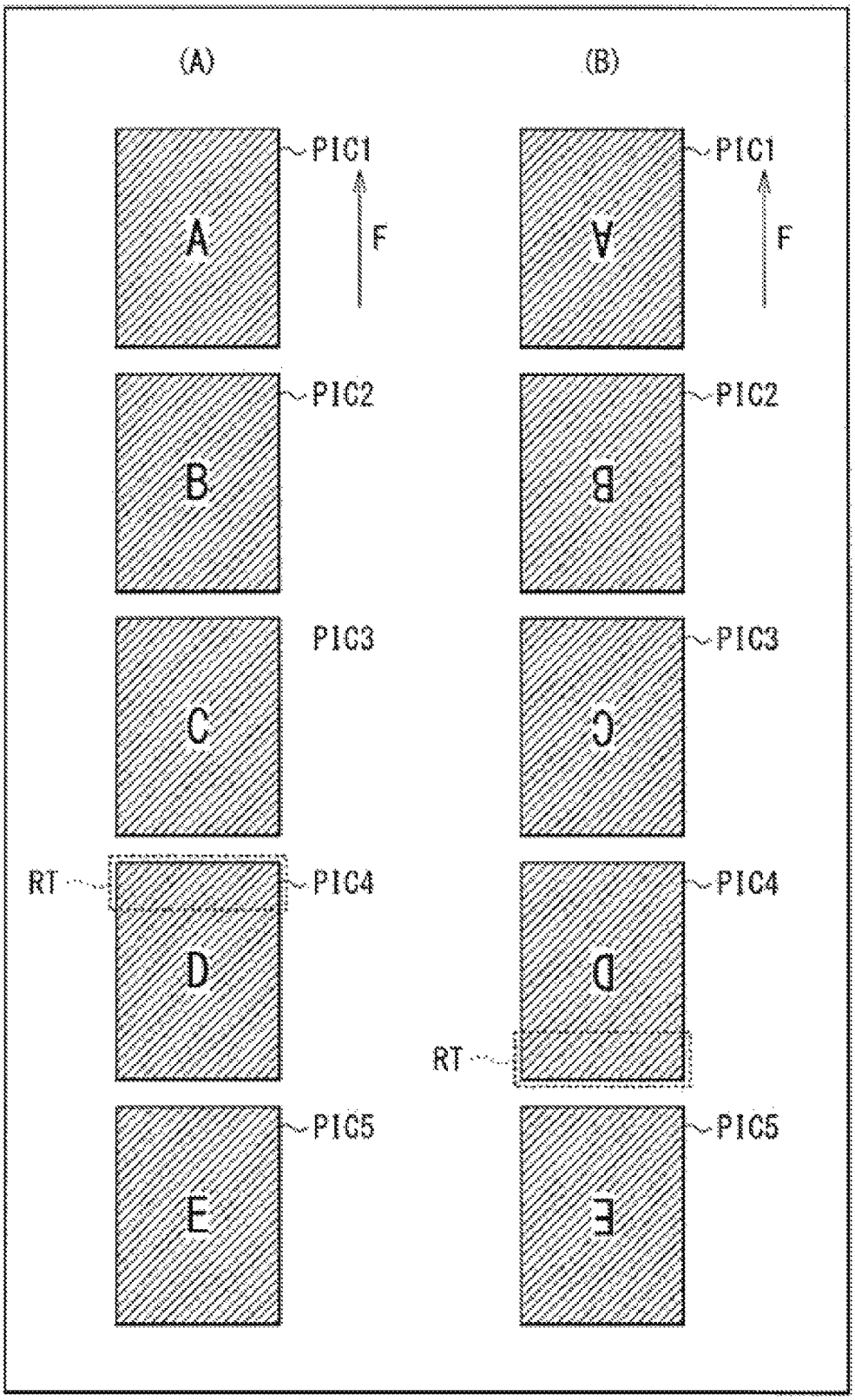
FIG. 12 is an explanatory diagram showing an operation example of the image forming apparatus of the first embodiment.

FIG. 12 shows the operations of the image forming apparatus 1 in the case C1 (FIG. 9), where (A) shows a case where the orientations of the page images PIC are not changed, and (B) shows a case where the orientations of the page images PIC are changed (this embodiment). As shown in FIG. 9, on the page image PIC4 selected by the image selection process A1 (S105), the leading edge density DT in the leading edge region RT is the highest among the four image densities D. Therefore, the image processing part 52 changes the orientations of five page images PIC so that the leading edge region RT comes near the trailing edge of the sheet 9 in the image orientation changing process A2 (FIG. 11). That is, the image processing part 52 rotates the five page images PIC by 180 degrees. As a result, as shown in FIG. 12B, the image forming apparatus 1 maintains the orientation of the sheets 9 as the portrait orientation, and also prints each of the five page images PIC1-PIC5 rotated by 180 degrees. Thereby, on the sheet 9 where the page image PIC4 is formed, because the toner density near the leading edge of the sheet 9 in the carrying direction F can be made low, the possibility that the sheet 9 winds around the heat roller 41 can be reduced.

Figure 13:
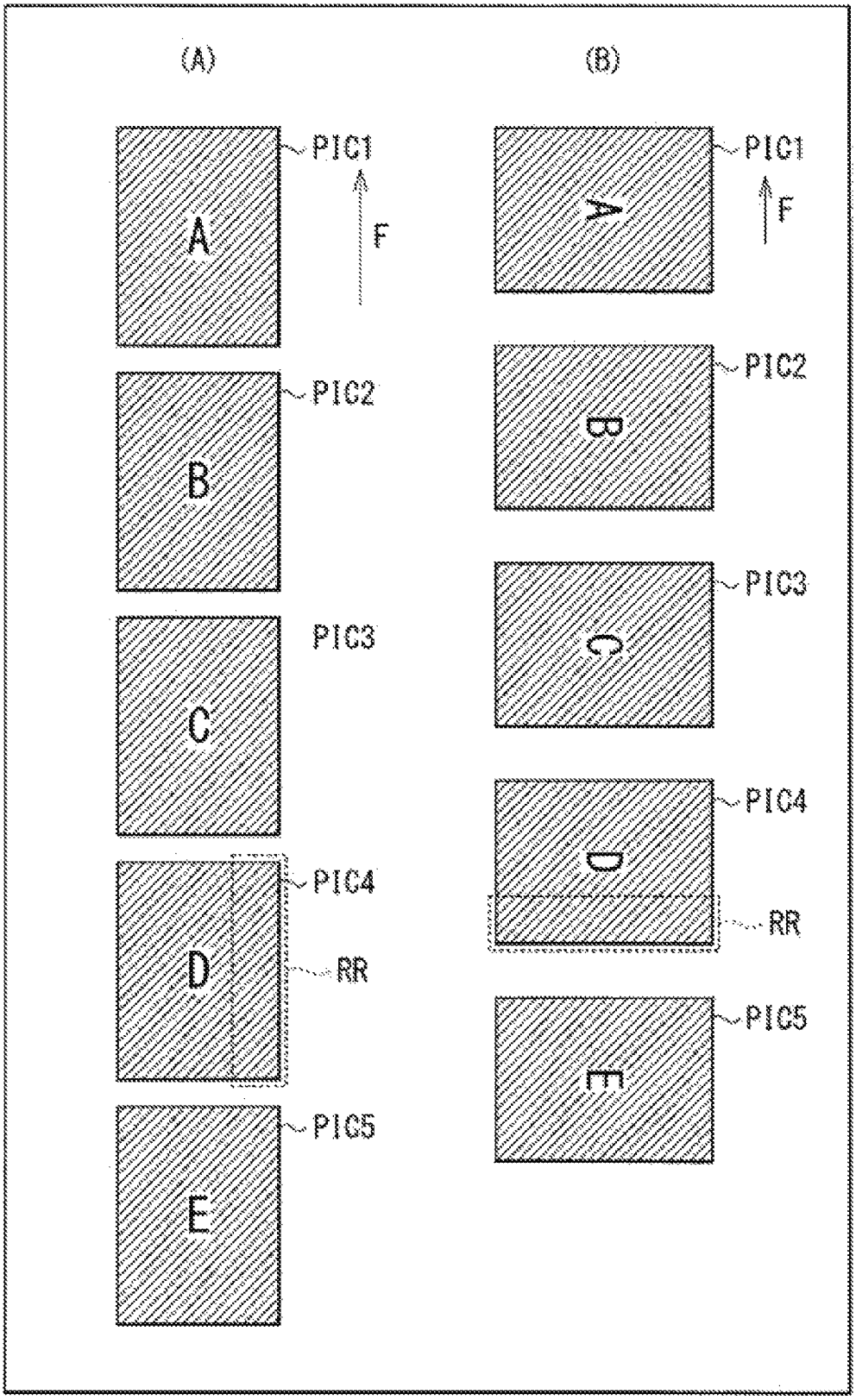
FIG. 13 is an explanatory diagram showing another operation example of the image forming apparatus of the first embodiment.

FIG. 13 shows the operations of the image forming apparatus 1 in the case C2 (FIG. 10), where (A) shows a case where the orientations of the page images PIC are not changed, and (B) shows a case where the orientations of the page images PIC are changed (this embodiment). As shown in FIG. 10, on the page image PIC4 selected by the image selection process A1 (S105), the right edge density DR in the right edge region RR is the highest among the four image densities D. Therefore, in the image orientation changing process A2 (FIG. 11), the image processing part 52 changes the orientations of the five page images PIC so that the right edge region RR comes near the trailing edge of the sheet 9. That is, the image processing part 52 rotates the five page images PIC clockwise by 90 degrees. As a result, as shown in FIG. 13B, the image forming apparatus 1 sets the orientation of the sheets 9 to the landscape orientation and prints each of the five page images PIC1-PIC5 rotated clockwise by 90 degrees. Thereby, on the sheet 9 where the page image PIC4 is formed, because the toner density near the leading edge of the sheet 9 in the carrying direction F can be made low, the possibility that the sheet 9 winds around the heat roller 41 can be reduced.

As mentioned above, in the image forming apparatus 1, the orientation of the page image PIC was changed so as to dispose the edge region R whose image density D is the highest among the four edge regions R on the page image PIC near the trailing edge of the sheet 9 in the carrying direction F. Thereby, in the image forming apparatus 1, the toner density near the leading edge of the sheet 9 in the carrying direction F can be made low, thereby making a jam of the sheet 9 hard to occur (or preventing sheet jam).

Particularly, in the image forming apparatus 1, because the orientation of the page image PIC is changed (or swapping the leading and trailing edges), for example, a jam of the sheet 9 can be made hard to occur without correcting the page image PIC for example. That is, for example, there can be a method to make a jam of the sheet 9 hard to occur by correcting the page image PIC so that the image density in the leading edge region RT becomes low. However, in this case, because the image itself is corrected, the image quality may decrease for example. On the other hand, in the image forming apparatus 1, because the orientation of the page image PIC is changed with no change in the image itself, the possibility that the image quality decreases can be reduced for example. Also, in the image forming apparatus 1, because a jam of the sheet 9 is made hard to occur by changing the orientation of the page image PIC in this manner, there is no need to add a member that can prevent a jam of the sheet 9, thereby increases in cost and size can be prevented for example.

Also, in the image forming apparatus 1, because the orientations of the multiple page images PIC are changed all at once based on the image densities on one page image PIC among the multiple page images PIC, the process can be simplified, and the user's convenience can be enhanced. That is, for example, if it is configured so as to change the orientations of the page images PIC by one page image PIC at a time, because the orientations of the page images PIC are judged individually by each page image PIC, the process may become complex. Also, because the sheets 9 in the portrait orientation and the sheets 9 in the landscape orientation are stacked in a mixed state on the ejection tray 19 after the images are formed, the user needs to match the orientations of the sheets 9 having the images formed, taking a labor. On the other hand, in the image forming apparatus 1, because the orientations of the multiple page images PIC are changed based on the image densities on one page image PIC among the multiple page images PIC, the process can be simplified. Also, the orientations of the sheets 9 stacked on the ejection tray 19 after the images are formed are all the portrait orientation or the landscape orientation. Therefore, because the orientations of the sheets 9 are matched, there is no need for the user to match the orientations of the sheets 9, enhancing the user's convenience.

[Efficacy]

As stated above, in this embodiment, because the orientation of a page image is changed so that an edge region having the highest image density among four edge regions of the page image comes near the trailing edge of a sheet of recording medium in the carrying direction, a jam of the sheet of recording medium can be made hard to occur.

In this embodiment, because the orientations of multiple page images are changed all at once based on the image densities of one page image among the multiple page images, the process can be simplified, and the user's convenience can be enhanced.

Modification Example 1

Although in the above-mentioned embodiment, the orientation of the page image PIC was determined based on the image density D in the four edge regions R, this invention is not limited to this. Instead, for example, the orientation of the page image PIC can be determined based on margin widths in the four edge regions R. Below, detailed explanations are given on an image forming apparatus 1A of this modification example.

The image forming apparatus 1A has an image processing part 52A in the same manner as in the image forming apparatus 1 of the above-mentioned first embodiment (FIG. 3). The image processing part 52A is configured so as to calculate the widths of margins (margin widths, MW) in four edge regions R on a page image PIC based on bitmap data, and correct the bitmap data by changing the orientation of the page image PIC based on the calculation result.

Figure 14:
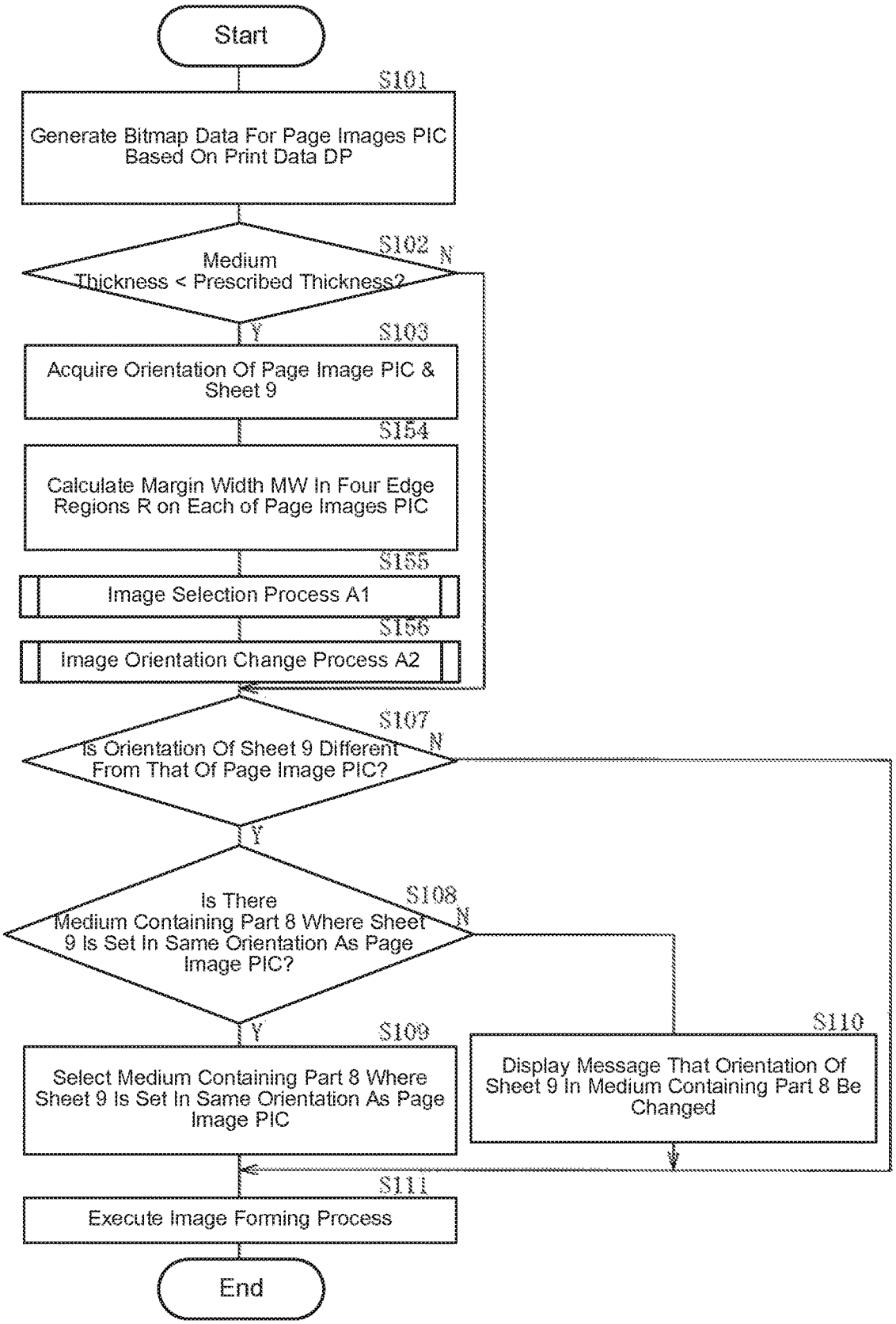
FIG. 14 is a flow chart showing an operation example of an image forming apparatus of a modification example of the first embodiment.

FIG. 14 shows an example of the operations of the image forming apparatus 1A.

First, in the same manner as in the above-mentioned first embodiment (FIG. 6), the image processing part 52A performs a prescribed process based on print data DP described in a PDL for example, thereby generating bitmap data of multiple page images PIC (S101).

Next, in the same manner as in the above-mentioned first embodiment (FIG. 6), the image processing part 52A acquires information on the thickness of a sheet 9 (medium thickness) contained in the print data DP, and checks whether the medium thickness is smaller than a prescribed thickness (S102). If the medium thickness is no smaller than the prescribed thickness ("N" in S102), the system proceeds to S107.

In S102, if the medium thickness is smaller than the prescribed thickness ("Y" in S102), in the same manner as in the above-mentioned first embodiment (FIG. 6), the image processing part 52A acquires information on the orientations of the sheet 9 and the page image PIC (S103).

Next, based on the bitmap data generated in S101, the image processing part 52A calculates the margin widths MW in the four edge regions R on each of the multiple page images PIC (S154).

Figure 15:
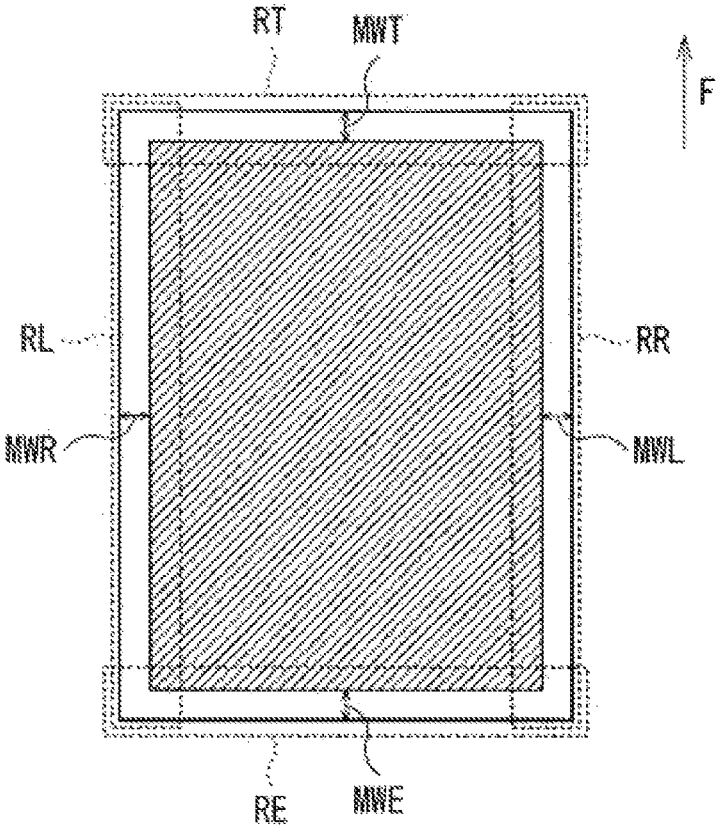
FIG. 15 is an explanatory diagram showing an example of margin widths in the edge regions.

FIG. 15 shows an example of the margin widths MW. Based on the bitmap data generated in S101, the image processing part 52A calculates the margin widths MW in the four edge regions R on each of the multiple page images PIC. The margin widths MW include a leading edge margin width MWT, a trailing edge margin width MWE, a left edge margin width MWL, and a right edge margin width MWR. The leading edge margin width MWT is the margin width MW in the leading edge region RT, the trailing edge margin width MWE is the margin width MW in the trailing edge region RE, the left edge margin width MWL is the margin width MW in the left edge region RL, and the right edge margin width MWR is the margin width MW in the right edge region RR. The image processing part 52A can calculate the margin widths MW in the four edge regions R by software for example.

Next, the image processing part 52A performs an image selection process A1 (S155).

Figure 16:
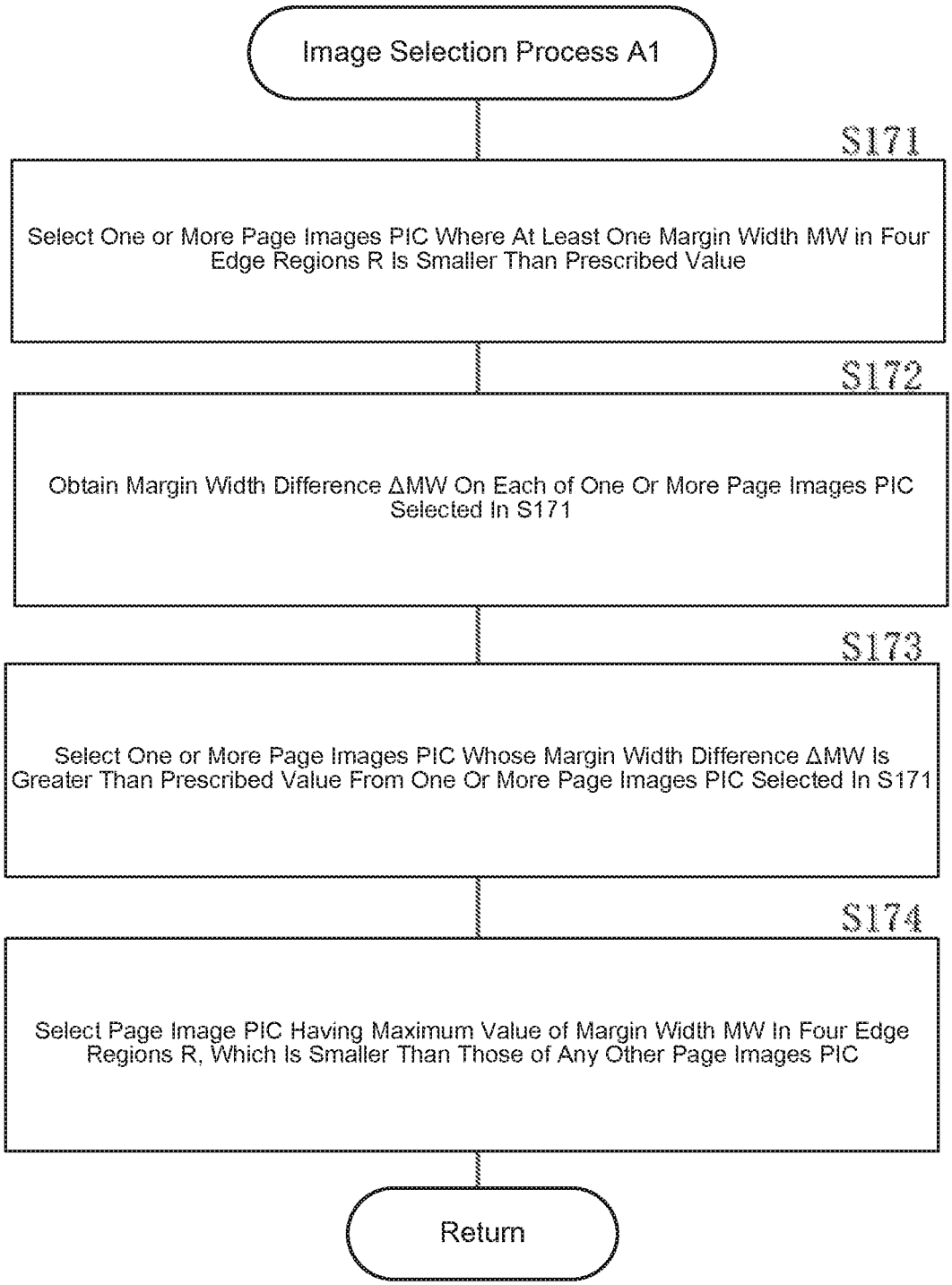
FIG. 16 is a flow chart showing an example of an image selection process shown in FIG. 14.

FIG. 16 shows an example of subroutines of the image selection process A1.

First, the image processing part 52A selects from the multiple page images PIC at least one page image PIC where at least one margin width MW in the four edge regions R is smaller than a prescribed value (S171). That is, the image processing part 52A excludes page images PIC where all the margin widths MW in the four edge regions R are greater than the prescribed value.

Next, the image processing part 52A obtains the difference between the maximum value and the minimum value of the margin widths MW (margin width difference ΔMW) in the four edge regions R on each of at least one page image PIC selected in S171 (S172).

Next, the image processing part 52A selects from at least one page image PIC selected in S171 at least one page image PIC whose margin width difference ΔMW is greater than a prescribed value (S173). That is, the image processing part 52A excludes page images PIC whose difference among margin widths MW in the four edge regions R is smaller than the prescribed value.

Next, the image processing part 52A selects from at least one page image PIC selected in S173 one page image PIC having the maximum value of the margin widths MW in the four edge regions R (S174), the maximum value being smaller than those of any other page images PIC.

Here, this subroutine ends.

Next, as shown in FIG. 14, the image processing part 52A performs an image orientation changing process A2 (S155).

Figure 17:
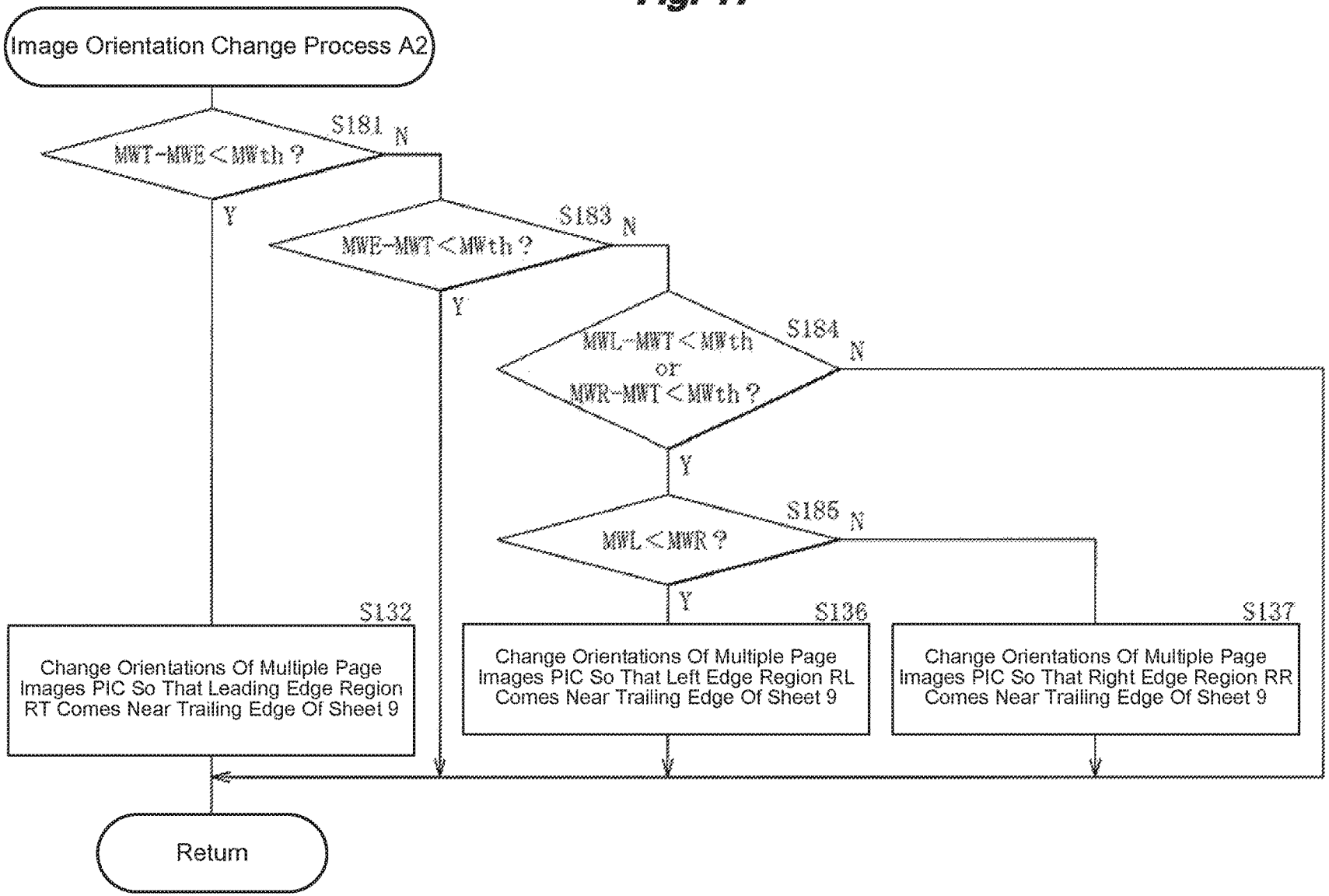
FIG. 17 is a flow chart showing an example of an image orientation changing process shown in FIG. 14.

FIG. 17 shows an example of subroutines of the image orientation changing process A2.

First, the image processing part 52A checks whether the difference between the leading edge margin width MWT and the trailing edge margin width MWE on a page image PIC selected in S174 is smaller than a prescribed threshold MWth (MWT−MWE<MWth) (S181). Here, the prescribed threshold has a negative value.

In S181, if the difference between the leading edge margin width MWT and the trailing edge margin width MWE is smaller than the prescribed threshold MWth ("Y" in S181), the image processing part 52A changes the orientations of the multiple page images PIC so that the leading edge region RT comes near the trailing edge of the sheet 9 (S132). That is, in this case, because the leading edge margin width MWT is smaller than the trailing edge margin width MWE, the image density D in the leading edge region RT is high. Therefore, if the leading edge region RT is disposed near the leading edge of the sheet 9, the sheet 9 may wind around the heat roller 41. Therefore, the image processing part 52A changes the orientations of the multiple page images PIC in order to dispose the leading edge region RT near the trailing edge of the sheet 9. Then, this subroutine ends.

In S181, if the difference between the leading edge margin width MWT and the trailing edge margin width MWE is no smaller than the prescribed threshold MWth ("N" in S181), the image processing part 52A checks whether the difference between the trailing edge margin width MWE and the leading edge margin width MWT on the page image PIC is smaller than the prescribed threshold MWth (MWE−MWT<MWth) (S183).

In S183, if the difference between the trailing edge margin width MWE and the leading edge margin width MWT is smaller than the prescribed threshold MWth ("Y" in S183), this subroutine ends. That is, in this case, because the leading edge margin width MWT is greater than the trailing edge margin width MWE, the image density D in the leading edge region RT is low. Therefore, if the leading edge region RT is disposed near the leading edge of the sheet 9, the possibility that the sheet 9 winds around the heat roller 41 is low. Therefore, the image processing part 52A does not change the orientations of the multiple page images PIC.

In S183, if the difference between the trailing edge margin width MWE and the leading edge margin width MWT is no smaller than the prescribed threshold MWth ("N" in S183), the image processing part 52A checks whether either the difference between the left edge margin width MWL and the leading edge margin width MWT is smaller than the prescribed threshold MWth (MWL−MWT<MWth) or the difference between the right edge margin width MWR and the leading edge margin width MWT is smaller than the prescribed threshold MWth (MWR−MWT<MWth) (S184).

In S184, if the difference between the left edge margin width MWL and the leading edge margin width MWT is no smaller than the prescribed threshold MWth and the difference between the right edge margin width MWR and the leading edge margin width MWT is no smaller than the prescribed threshold MWth ("N" in S184), this subroutine ends. That is, in this case, the leading edge margin width MWT is about the same as the trailing edge margin width MWE, and both the left edge margin width MWL and the right edge margin width MWR are about the same as or greater than the leading edge margin width MWT. In other words, the leading edge density DT is about the same as the trailing edge density DE, and both the left edge density DL and the right edge density DR are about the same as or smaller than the leading edge density DT. Thereby, if the leading edge region RT is disposed near the leading edge of the sheet 9, the possibility that the sheet 9 winds around the heat roller is low. Therefore, the image processing part 52A does not change the orientations of the multiple page images PIC.

In S184 if either the difference between the left edge margin width MWL and the leading edge margin width MWT is smaller than the prescribed threshold MWth or the difference between the right edge margin width MWR and the leading edge margin width MWT is smaller than the prescribed threshold MWth ("Y" in S184), the image processing part 52A checks whether the left edge margin width MWL is smaller than the right edge margin width MWR (MWL<MWR) (S185).

In S185, if the left edge margin width MWL is smaller than the right edge margin width MWR ("Y" in S185), the image processing part 52A changes the orientations of the multiple page images PIC so that the left edge region RL comes near the trailing edge of the sheet 9 (S136). That is, in this case, because the left edge margin width MWL is smaller than the right edge margin width MWR, the image density D in the left edge region RL is high. Therefore, if the left edge region RL is disposed near the leading edge of the sheet 9, the sheet 9 may wind around the heat roller 41. Therefore, the image processing part 52A changes the orientations of the multiple page images PIC so as to dispose the left edge region RL near the trailing edge of the sheet 9. Then, this subroutine ends.

In S185, if the left edge margin width MWL is no smaller than the right edge margin width MWR ("N" in S185), the image processing part 52A changes the orientations of the multiple page images PIC so that the right edge region RR comes near the trailing edge of the sheet 9 (S137). That is, in this case, because the right edge margin width MWR is smaller than the left edge margin width MWL, the image density D in the right edge region RR is high. Therefore, if the right edge region RR is disposed near the leading edge of the sheet 9, the sheet 9 may wind around the heat roller 41. Therefore, the image processing part 52A changes the orientations of the multiple page images PIC so as to dispose the right edge region RR near the trailing edge of the sheet 9. Then, this subroutine ends Afterwards, as shown in FIG. 14, in the same manner as in the above-mentioned first embodiment (FIG. 6), the image forming apparatus 1A performs the operations in S107-S111.

As stated above, in the image forming apparatus 1A, the orientations of the page images PIC are changed so that the edge region R having the smallest margin width MW among the four edge regions R of the page image PIC is disposed near the trailing edge of the sheet 9 in the carrying direction F. Thereby, in the image forming apparatus 1A, the toner density near the leading edge of the sheet 9 in the carrying direction F can be made low, thereby making a jam of the sheet 9 hard to occur.

2. Second Embodiment

Next, explanations are given on an image forming apparatus 2 of the second embodiment. The image forming apparatus 2 is configured so that after a jam of a sheet 9 occurred, based on a page image PIC for the jammed sheet 9, the orientation of the page image PIC is changed, and an image is formed based on the page image PIC. Note that components that are essentially the same as those in the image forming apparatus 1 of the above-mentioned first embodiment are given the same codes, and their explanations are omitted as appropriate.

As shown in FIG. 3, the image forming apparatus 2 is provided with an image processing part 72 and a printer engine control part 77.

The image processing part 72 is configured so as to notify the printer engine control part 77 that the image forming apparatus 2 has received print data DP, and perform a prescribed process based on the print data DP supplied from an interface part 51 according to an instruction from the printer engine control part 77, thereby generating bitmap data. Also, if a jam of a sheet 9 occurs in a fuser part 40, based on this bitmap data, the image processing part 72 calculates image densities D in four edge regions R of the page image PIC for the jammed sheet 9 (a page image PICA). Then, based on the calculation result, the image processing part 72 changes the orientations of the page image PICA and all the following page images PIC, thereby correcting the bitmap data.

The printer engine control part 77 is configured so as to control individual blocks of the image forming apparatus 2.

Figure 18:
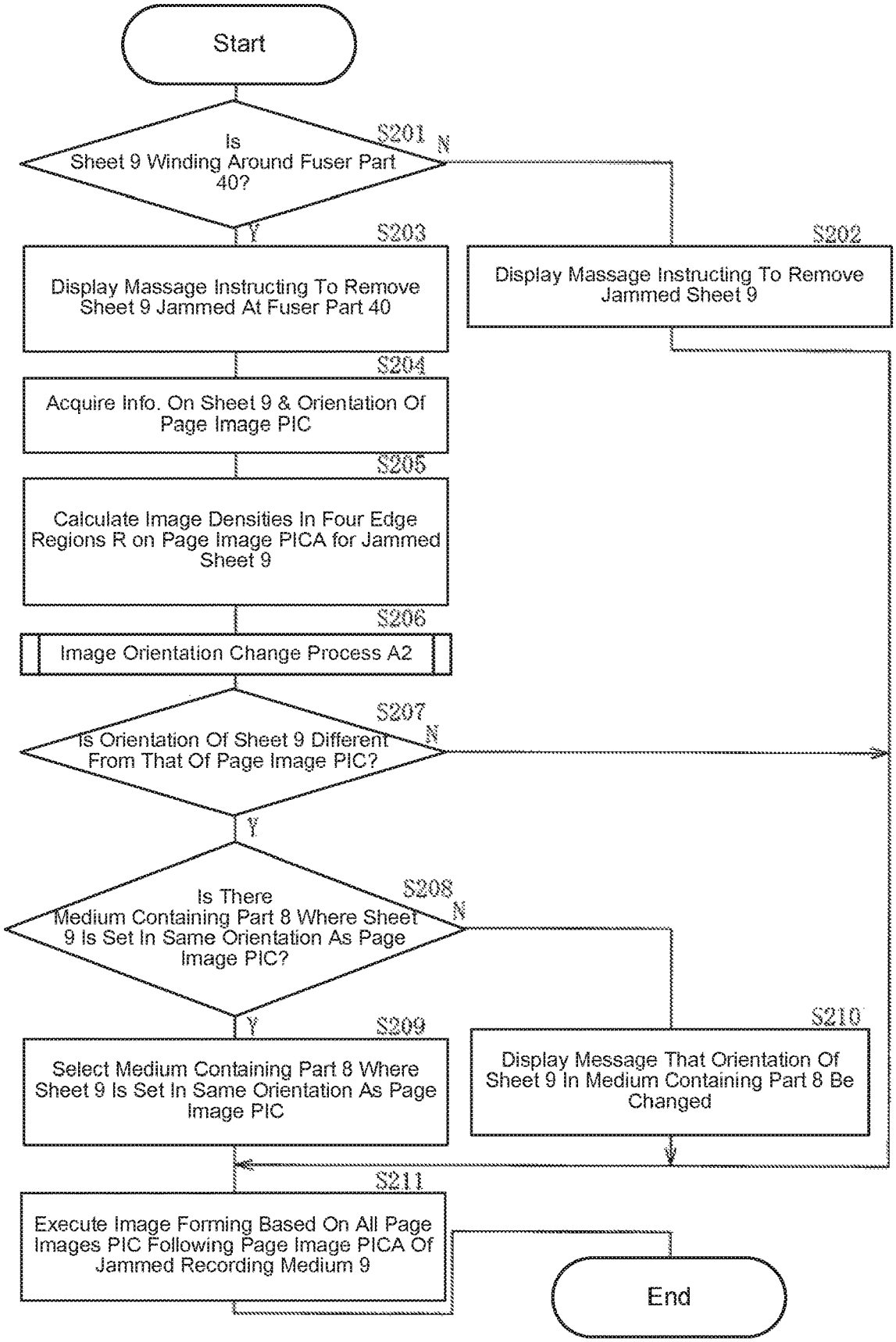
FIG. 18 is a flow chart showing an operation example of an image forming apparatus of the second embodiment.

FIG. 18 shows an example of the operations of the image forming apparatus 2 after a jam of the sheet 9 occurred. In this example, the print data DP supplied from a host computer contains information on multiple page images PIC. Based on such print data DP, the image processing part 72 generates bitmap data. Then, based on this bitmap data, the image forming apparatus 2 forms images on the sheet 9. Once a winding detection part 68 of the printer engine control part 77 has detected winding of a sheet 9 in the fuser part 40, based on the image densities D in the four edge regions R of the page image PIC for the jammed sheet 9 (the page image PICA), the image processing part 72 changes the orientations of this page image PICA and all the page images PIC thereafter, thereby correcting the bitmap data. Then, based on the corrected bitmap data, the image forming apparatus 2 forms images on the sheets 9. Below, this operation is explained in detail.

First, after a jam of the sheet 9 occurred in the image forming apparatus 2, the winding detection part 68 of the printer engine control part 77 checks whether the jam of the sheet 9 is due to the sheet 9 winding around the fuser part 40 (S201).

In S201, if the jam of the sheet 9 is not due to the sheet 9 winding in the fuser part 40 ("N" in S201), according to an instruction from the printer engine control part 77, a display operation part 54 displays a message instructing a user to remove the jammed sheet 9 (S202). Following this message, the user removes the sheet 9 jammed in the image forming apparatus 2. Then, the system proceeds to S211.

In S201, if the jam of the sheet 9 is due to the sheet 9 winding in the fuser part 40 ("Y" in S201), according to an instruction from the printer engine control part 77, the display operation part 54 displays a message instructing the user to remove the sheet 9 jammed at the fuser part 40 (S203). Following this message, the user removes the sheet 9 jammed in the fuser part 40.

Next, in the same manner as in S103 in the above-mentioned first embodiment (FIG. 6), the image processing part 72 acquires information on the orientations of the sheet 9 and the page image PIC (S204).

Next, the image processing part 72 calculates the image densities D in the four edge regions R on the page image PICA for the jammed sheet 9 (S205). Specifically, in the same manner as the image processing part 52 of the above-mentioned first embodiment, based on the bitmap data, the image processing part 72 calculates a leading edge density DT in a leading edge region RT, a trailing edge density DE in a trailing edge region RE, a left edge density DL in a left edge region RL, and a right edge density DR in a right edge region RR on the page image PICA.

Next, the image processing part 72 performs an image orientation changing process B (S206).

Figure 19:
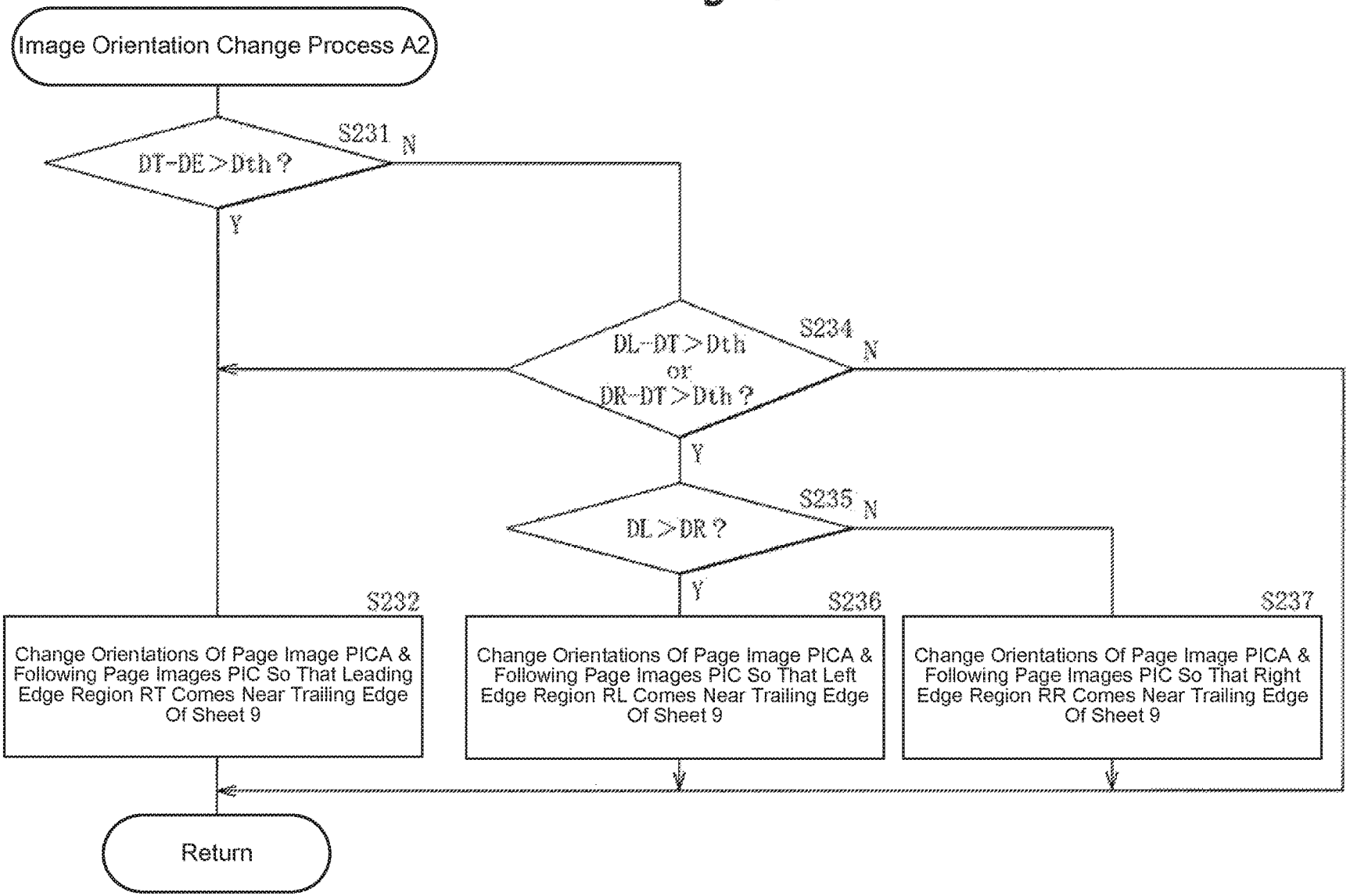
FIG. 19 is a flow chart showing an example of an image orientation changing process shown in FIG. 18.

FIG. 19 shows an example of subroutines of the image orientation changing process B. Based on the image densities D in the four edge regions R on the page image PICA calculated in S205, the image processing part 72 changes the orientations of the page image PICA and all the following page images PIC contained in the print data DP, thereby correcting the bitmap data. Below, this operation is explained in detail.

First, the image processing part 72 checks whether the difference between the leading edge density DT and the trailing edge density DE on the page image PICA is greater than a prescribed threshold Dth (DT−DE>Dth) (S231). Here, the prescribed threshold Dth has a positive value.

In S231, if the difference between the leading edge density DT and the trailing edge density DE is greater than the prescribed threshold Dth ("Y" in S231), the image processing part 72 changes the orientations of the page image PICA and all the following page images PIC so that the leading edge region RT comes near the trailing edge of the sheet 9 (S232). That is, in this case, because the leading edge density DT is higher than the trailing edge density DE, if the leading edge region RT is disposed near the leading edge of the sheet 9, the sheet 9 may wind around the heat roller 41. Therefore, the image processing part 72 changes the orientations of the page image PICA and all the following page images PIC so as to dispose the leading edge region RT near the trailing edge of the sheet 9. In this case, the orientation of the page images PIC is, for example, longitudinal to the carrying direction F of the sheets 9. Then, this subroutine ends.

In S231, if the difference between the leading edge density DT and the trailing edge density DE is no greater than the prescribed threshold Dth ("N" in S231), the image processing part 72 checks whether either the difference between the left edge density DL and the leading edge density DT is greater than the prescribed threshold Dth (DL−DT>Dth) or the difference between the right edge density DR and the leading edge density DT is greater than the prescribed threshold Dth (DR−DT>Dth) (S234).

In S234, if the difference between the left edge density DL and the leading edge density DT is no greater than the prescribed threshold Dth and the difference between the right edge density DR and the leading edge density DT is no greater than the prescribed threshold Dth ("N" in S234), the system proceeds to S232. That is, in this case, the leading edge density DT is about the same as or lower than the trailing edge density DE, and both the left edge density DL and the right edge density DR are about the same as or lower than the leading edge density DT. Therefore, if the leading edge region RT is disposed near the leading edge of the sheet 9, the possibility that the sheet 9 winds around the heat roller 41 is believed to be low. However, in the image forming apparatus 2, by disposing the leading edge region RT of the page image PICA near the leading edge of the sheet 9, a jam of the sheet 9 has occurred in the fuser part 40. Therefore, the image processing part 72 changes the orientations of the page image PICA and all the following page images PIC so as to dispose the leading edge region RT near the trailing edge of the sheet 9. Then, this subroutine ends.

In S234, if either the difference between the left edge density DL and the leading edge density DT is greater than the prescribed threshold Dth or the difference between the right edge density DR and the leading edge density DT is greater than the prescribed threshold Dth ("Y" in S234), the image processing part 72 checks whether the left edge density DL is higher than the right edge density DR (DL>DR) (S235).

In S235, if the left edge density DL is higher than the right edge density DR ("Y" in S235), the image processing part 72 changes the orientations of the page image PICA and all the following page images PIC so that the left edge region RL comes near the trailing edge of the sheet 9 (S236). That is, in this case, because the left edge density DL is higher than the right edge density DR, if the left edge region RL is disposed near the leading edge of the sheet 9, the sheet 9 may wind around the heat roller 41. Therefore, the image processing part 72 changes the orientations of the page image PICA and all the following page images PIC so as to dispose the left edge region RL near the trailing edge of the sheet 9. In this case, the orientation of the page images PIC is, for example, lateral to the carrying direction F of the sheets 9. Then, this subroutine ends.

In S235, if the left edge density DL is no higher than the right edge density DR ("N" in S235), the image processing part 72 changes the orientations of the page image PICA and all the following page images so that the right edge region RR comes near the trailing edge of the sheet 9 (S237). That is, in this case, because the right edge density DR is higher than the left edge density DL, if the right edge region RR is disposed near the leading edge of the sheet 9, the sheet 9 may wind around the heat roller 41. Therefore, the image processing part 72 changes the orientations of the page image PICA and all the following page images PIC so as to dispose the right edge region RR near the trailing edge of the sheet 9. In this case, the orientation of the page images PIC is, for example, lateral to the carrying direction F of the sheets 9. Then, this subroutine ends.

Next, as shown in FIG. 18, in the same manner as in S107 in the above-mentioned first embodiment (FIG. 6), the image processing part 72 checks whether the orientation of the sheets 9 set in a medium containing part 8 is different from the orientation of the page images PIC (S207). If the orientation of the sheets 9 in the medium containing part 8 matches with the orientation of the page image PIC ("N" in S207), the system proceeds to S211.

In S207, if the orientation of the sheets 9 in the medium containing part 8 is different from the orientation of the page images PIC ("Y" in S207), in the same manner as in S108 in the above-mentioned first embodiment (FIG. 6), the printer engine control part 77 checks whether there is a medium containing part 8 where sheets 9 are set in the same orientation as the orientation of the page images PIC (S208).

In S208, if there is a medium containing part 8 where sheets 9 are set in the same orientation as the orientation of the page images PIC ("Y" in S208), in the same manner as in S109 in the above-mentioned first embodiment (FIG. 6), the printer engine control part 77 selects the medium containing part 8 where the sheets 9 are set in the same orientation as the orientation of the page images PIC as the supply source of the sheet 9 (S209).

In S208, if there is no medium containing part 8 where sheets 9 are set in the same orientation as the orientation of the page image PIC ("N" in S208), in the same manner as in S110 in the above-mentioned first embodiment (FIG. 6), according to an instruction from the printer engine control part 77, the display operation part 54 displays a message notifying the user that the orientation of the sheets 9 in the medium containing part 8 should be changed (S210). Following this message, the user changes the orientation of the sheets 9 in the medium containing part 8 for example. Also, if the image forming apparatus 2 has a manual-feed tray, sheets 9 in a desired orientation may be set to this manual-feed tray. Thereby, the orientation of the sheets 9 matches with the orientation of the page images PIC Then, based on the jammed page image PICA and all the following page images PIC, the image forming apparatus 2 executes a forming process to form images on the sheets 9 (S211). That is, because the page images PIC preceding the jammed page image PICA are already printed, the image forming apparatus 2 starts printing sequentially from the page image PICA.

Here, this flow ends.

As stated above, in the image forming apparatus 2, if a jam of a sheet 9 occurs in the fuser part 40, an edge region R whose image density D is the highest among the four edge regions R of the page image PICA for the jammed sheet 9 is disposed near the trailing edge of the sheet 9 in the carrying direction F. Thereby, in the image forming apparatus 2, because the orientation of the page image PICA can be changed based on the image density D on the page image PICA for the actually jammed sheet 9, the possibility of a sheet 9 jamming again can be reduced.

Also, in the image forming apparatus 2, the orientation of the page image PICA is changed to a different orientation from the one when the sheet 9 jammed. That is, as shown in FIG. 19, regardless of the relation among the four image densities D (the leading edge density DT, the trailing edge density DE, the left edge density DL, and the right edge density DR), the orientation of the page image PICA for the jammed sheet 9 is changed. Thereby, the possibility of a sheet 9 jamming again can be reduced.

As stated above, in this embodiment, if a recording medium jam has occurred in the fuser part, an edge region whose image density is the highest among the four edge regions of the page image PICA for the jammed sheet of recording medium is disposed near the trailing edge of the sheet of recording medium in the carrying direction, thereby the possibility of a sheet of recording medium jamming again can be reduced.

Also, in this embodiment, because the orientation of the page image PICA is changed to a different orientation from the one when the sheet 9 jammed, the possibility of a sheet of recording medium jamming again can be reduced.

Other effects are the same as in the above-mentioned first embodiment.

Modification Example 2

Although in the above-mentioned embodiment, the orientations of the page image PICA and all the following page images PIC were determined based on the image densities D in the four edge regions R on the page image PICA, this invention is not limited to this. Instead, for example, in the same way as in Modification Example 1 of the first embodiment, the orientations of the page image PICA and all the following page images PIC can be determined based on the margin widths in the four edge regions R on the page image PICA.

Although this technology was explained above referring to several embodiments and modification examples, their specific application examples, and example applications to electronic equipment, this technology is not limited to these embodiments etc., but various modifications are possible.

For example, although in the above-mentioned embodiments, the sheets 9 were initially set in the portrait orientation in the medium containing part 8 as shown in FIG. 7, this invention is not limited to this. Instead, the sheets 9 can be initially set in the landscape orientation in the medium containing part 8.

For example, although in the above-mentioned embodiments etc., this technology was applied to single-function printers, this invention is not limited to them but instead can be applied to so-called a multi-function peripheral (MFP) having a copy function, a facsimile function, a scan function, a print function, etc.

For example, although in the above-mentioned embodiments etc., the toner images formed by the development units 14 were directly transferred to a sheet 9, this invention is not limited to this. Instead, for example, the toner images formed by the development units 14 can be tentatively transferred (primary-transferred) to an intermediate transfer belt, and the toner images transferred to the intermediate transfer belt can be transferred (secondary-transferred) to a sheet 9.

What is claimed is:

1. An image forming apparatus, comprising:

a receiving part that receives multiple page images including a first page image and a second page image, which either leads or follows the first page image, from an external device, each of the first and second page images being to be formed on one of recording media wherein the first and second page images are in a rectangular shape with four sides surrounding their boundaries and each have orientations that coincides with a carrying direction of the recording media, and in accordance with the orientations, one leading side, one trailing side and two lateral sides, which are positioned between the leading side and the trailing side, are defined from the four sides of the first and second page images, an image processing part that calculates image densities of four edge regions that correspond to the four sides of the first page image so as to obtain a calculation result, and changes the orientations of the first and second page images based on the calculation result, a medium carrying part that carries the recording media, and an image forming part that forms images on the recording media carried by the medium carrying part based on the first and second page images processed by the image processing part, wherein the image processing part determines one edge region of the first page image, which has the highest image density among the four edge regions on the first page image, changes the orientation of the first page image such that the one edge region having the highest image density is arranged to be at the trailing side of the first page image, and changes the orientation of the second page image to the same orientation as that of the first page image.

2. The image forming apparatus according to claim 1, wherein the second page image is to be formed next to the first page image, and the image processing part calculates the image densities of the four edge regions on each of the multiple page images, which are received by the receiving part so as to obtain another calculation result, selects the first page image from the multiple page images based on the another calculation result so that the orientations of the selected first page image and the second page image, which follows the first page image, are changed.

3. The image forming apparatus according to claim 2, wherein the image processing part determines a minimum value of the image densities of the four edge regions on each of the multiple page images, selects one page image whose the minimum value of the image densities is the largest among the multiple page images, and makes the selected one page image the first page image.

4. The image forming apparatus according to claim 3, wherein the image processing part stores a first prescribed value, selects one or more page images from the multiple page images, the one or more page images having a density difference between the maximum value and the minimum value of the image densities in the four edge regions is greater than the second prescribed value wherein these image pages are defined as selected image pages, and selects the first page image from the selected page images.

5. The image forming apparatus according to claim 2, wherein the image processing part stores a first prescribed value, selects one or more page images from the multiple page images, the one or more page images having an image density in any of the four edge regions, which is greater than the first prescribed value wherein these image pages are defined as selected image pages, and selects the first page image from the selected page images.

6. The image forming apparatus according to claim 1, wherein the second page image is to be printed prior to the first page image, and the image processing part calculates the image densities of the four edge regions on each of the multiple page images, which are received by the receiving part so as to obtain another calculation result, selects the first page image from the multiple page images based on the another calculation result so that the orientations of the selected first page image and the second page image, which leads the first page image, are changed.

7. The image forming apparatus according to claim 1, wherein in a case where a trouble occurs to the medium carrying part while the image forming part is forming an image based on the first page image, an image, which is formed on the recording medium first after the trouble occurred to the medium carrying part, is determined as the first page image.

8. The image forming apparatus according to claim 7, wherein the image processing part changes the orientation of the first page image in order to become different from the orientation of the first page image when the trouble occurred.

9. The image forming apparatus according to claim 1, wherein the medium carrying part further has a fuser part that fuses an image formed on the recording medium by the image forming part on the recording medium.

10. An image forming apparatus, comprising:

a receiving part that receives multiple page images including a first page image and a second page image, which either leads or follows the first page image, from an external device, each of the first and second page images being to be formed on one of recording media wherein the first and second page images are in a rectangular shape with four sides surrounding their boundaries and each have orientations that coincides with a carrying direction of the recording media, and in accordance with the orientations, one leading side, one trailing side and two lateral sides, which are positioned between the leading side and the trailing side, are defined from the four sides of the first and second page images, an image processing part that calculates margin widths of four edge regions that correspond to the four sides of the first page image so as to obtain a calculation result, and changes the orientations of the first and second page images based on the calculation result, a medium carrying part that carries the recording media, and an image forming part that forms images on the recording media carried by the medium carrying part based on the first and second page images processed by the image processing part, wherein the image processing part determines one edge region of the first page image, which has the narrowest margin width among the four edge regions on the first page image, changes the orientation of the first page image such that the one edge region having the narrowest margin width is arranged to be at the trailing side of the first page image, and changes the orientation of the second page image to the same orientation as that of the first page image.

11. The image forming apparatus according to claim 10, wherein the second page image is to be formed next to the first page image, and the image processing part calculates the margin widths of the four edge regions on each of the multiple page images received by the receiving part so as to obtain another calculation result, selects the first page image based on the another calculation result so that the orientations of the selected first page image and the second page image, which follows the first page image, are changed.

12. The image forming apparatus according to claim 10, wherein the second page image is to be formed prior to the first page image, and the image processing part calculates the margin widths of the four edge regions on each of the multiple page images received by the receiving part so as to obtain another calculation result, selects the first page image based on the another calculation result so that the orientations of the selected first page image and the second page image, which leads the first page image, are changed.

13. The image forming apparatus according to claim 11, wherein the image processing part selects as the first page image a page image whose maximum value of the margin widths of the four edge regions is the smallest among the multiple page images.

14. The image forming apparatus according to claim 10, wherein in a case where a trouble occurs to the medium carrying part while the image forming part is forming an image based on the first page image, an image, which is formed on the recording medium first after the trouble occurred to the medium carrying part, is determined as the first page image.

* * * * *